United States Patent [19]

Yoshida et al.

[11] Patent Number: 5,077,180

[45] Date of Patent: Dec. 31, 1991

[54] METHOD FOR PROCESSING SILVER HALIDE COLOR PHOTOGRAPHIC MATERIAL

[75] Inventors: Kazuaki Yoshida; Takatoshi Ishikawa, both of Minami-ashigara, Japan

[73] Assignee: Fuji Photo Film Co., Ltd., Kanagawa, Japan

[21] Appl. No.: 663,774

[22] Filed: Mar. 4, 1991

Related U.S. Application Data

[63] Continuation of Ser. No. 261,458, Oct. 19, 1988, abandoned.

[30] Foreign Application Priority Data

Oct. 19, 1987 [JP] Japan ..... 62-263629

[51] Int. Cl.[5] ..... G03C 7/30

[52] U.S. Cl. ..... 430/380; 430/376; 430/468; 430/469; 430/490; 430/399; 430/963

[58] Field of Search ..... 430/376, 380, 399, 963, 430/468, 469, 490

[56] References Cited

U.S. PATENT DOCUMENTS

| | | | |
|---|---|---|---|
| 4,774,167 | 9/1988 | Koshimizu et al. | 430/380 |
| 4,797,351 | 1/1989 | Ishikawa et al. | 430/387 |
| 4,798,783 | 1/1989 | Ishikawa et al. | 430/380 |
| 4,800,153 | 1/1989 | Morimoto et al. | 430/380 |
| 4,801,516 | 1/1989 | Ishikawa et al. | 430/435 |
| 4,801,521 | 1/1989 | Ohki et al. | 430/380 |
| 4,818,673 | 4/1989 | Ueda et al. | 430/502 |
| 4,833,068 | 5/1989 | Ohki et al. | 430/484 |
| 4,876,174 | 10/1989 | Ishikawa et al. | 430/469 |
| 4,892,804 | 1/1990 | Vincent et al. | 430/380 |
| 5,001,041 | 3/1991 | Kishimoto et al. | 430/380 |

FOREIGN PATENT DOCUMENTS

| | | | |
|---|---|---|---|
| 1373861 | 8/1964 | European Pat. Off. . | |
| 0029722 | 6/1981 | European Pat. Off. . | |
| 0032456 | 7/1981 | European Pat. Off. . | |
| 0211437 | 2/1987 | European Pat. Off. . | |
| 232342 | 12/1984 | Japan . | |
| 70552 | 4/1986 | Japan . | |
| 14146 | 1/1988 | Japan | 430/380 |

OTHER PUBLICATIONS

Copending Application Ser. No. 07/063469 filed 6/18/87.

*Primary Examiner*—Richard L. Schilling
*Attorney, Agent, or Firm*—Sughrue, Mion, Zinn, Macpeak & Seas

[57] ABSTRACT

A method for continuously processing silver halide color photographic material with a color developer containing at least one aromatic primary amine color-developing agent is disclosed. In the method a silver halide color photographic material at least one of the layers of which contains a silver halide emulsion of a high chloride comprising 80 mol % or over of silver chloride is processed, after exposure to light, with a color developer that is substantially free from sulfite ions and whose replenishing amount is 120 ml or below per $m^2$ of the silver halide photographic material, to attain desired photographic characteristics.

10 Claims, No Drawings

METHOD FOR PROCESSING SILVER HALIDE COLOR PHOTOGRAPHIC MATERIAL

This is a continuation of application Ser. No. 07/261,458 filed Oct. 19, 1988, now abandoned.

BACKGROUND OF THE INVENTION (1) Field of the Invention

The present invention relates to a method for processing silver halide color photographic materials, and in particular a method for developing silver halide color photographic materials in which the replenishing amount of the color developer is reduced considerably.

(2) Description of the Prior Art

Processing a silver halide color photographic material basically is composed of two steps of color development (for a color reversal material, black and white first development before it), and desilvering, and the desilvering comprises of a bleaching step and a fixing step, or a monobath bleach-fixing step that may be used alone or in combination with the bleaching step and the fixing step. If necessary, additional processing steps may be added, such as a washing step, a stopping step, a stabilizing step, and a pretreatment step to accelerate development.

In the color development, silver halide that has been exposed to light is reduced to silver, and at the same time the oxidized aromatic primary amine color-developing agent reacts with a coupler to form a dye. In this process, halogen ions resulted from the decomposition of the silver halide dissolve into the developer and accumulate therein. On the other hand, the color-developing agent is consumed by the above-mentioned reaction with the coupler. Further, other components in the color developer will be held into the photographic material and taken out, so that the concentrations of components in the developer lower gradually. Therefore, in a development method that continuously processes a large amount of a silver halide photographic material, for example by an automatic-developing processor, in order to avoid a change in the finished photographic characteristics after development caused by a change in the concentrations of the components, some means is required to keep the concentrations of the components of the color developer within certain ranges.

For instance, if the influence of the condensation of a component that will be consumed, such as developing agents and preservatives, is small, generally its concentration in the replenisher has previously been made higher. In some cases, a material that will flow out and that has an effect of restraining development is contained in a lower concentration in a replenisher, or is not contained in the replenisher. In other cases, a compound may be contained in a replenisher in order to remove the influence of a material that will flow out from the photographic material. Further, in other cases, for example, the pH, the alkali, or the concentration of a chelating agent is adjusted. As measures for them, usually a method of replenishing with replenishers is used that will supply insufficient components and dilute the increased components. The replenishment with the replenishers, however, necessarily results in a large amount of overflow, which creates large economic and public pollution problems.

In recent years, for the purpose of saving resources and avoiding the public pollution, it has been earnestly desired to reduce the replenishing amount of the developer as well as to accelerate the developing process. However, if the replenishing amount of a color developer is simply lowered, an exudate from the photographic material, in particular bromide ions that are a strong development restrainer, accumulates, resulting in a problem that lowers the development activity and impedes the development speed. To solve this problem, a technique of accelerating the development is required, and many such techniques that enable the replenishing amount to be lowered have been studied. One such known technique, for example, is to increase the pH and the processing temperature of the developer, thereby making the development rapid. This technique, however, causes such serious problems as a high degree of fogging, reduced stability of the developer, and a fluctuation of photographic characteristics as continuous processing increases. Another acceleration technique that involves adding various development accelerators is known, but it has not been satisfactorily effective.

For the purpose of lowering the accumulation of bromide ions, which are a strong development restrainer, thereby intending to make the development rapid, JP-A ("JP-A" means unexamined published Japanese patent application) Nos. 95345/1983, 232342/1984, and 70552/1986 and WO No. 04534/1987 disclose methods wherein silver halide photographic materials having high contents of silver chloride are used, and the methods are considered as effective means of lowering the replenishing amount of the developer without marring the rapidness of the development. It was found, however, that the methods were not of practical use because new problems arose that when the replenishing amount of the developer was intended to be lowered without marring the rapidness of the development, the photographic characteristics changed conspicuously in the continuous process, and a suspended matter considered as silver exuded from the photographic material occurred in the processing solution, which soiled the rollers of the processor, clogged a filter, and soiled or damaged the photographic material.

At present, although the replenishing amount of a color developer varies a little depending on the photographic material to be developed, generally it is required that the replenishing amount is on the order of 180 to 1000 ml per $m^2$ of the photographic material to be processed. This is because if the replenishing amount is lowered while avoiding marring the rapidness of the development, the occurrence of quite serious problems, that the photographic characteristics change greatly and that a suspended matter arises in the developer, is anticipated in the continuous process, as stated above, and because any technique fundamentally enabling these problems to be solved has not yet been found.

BRIEF SUMMARY OF THE INVENTION

Therefore, the first object of the present invention is to provide a developing method of a photographic material wherein the replenishing amount of the color developer can be lowered remarkably without marring the rapidness of the process, and the photographic characteristics, in particular the minimum density, the maximum density, and the gradation, change less in the continuous process.

The second object of the present invention is to provide a developing method wherein a high-sliver-chloride-content photographic material is used, the replenishing amount of the color developer can be lowered remarkably, and there is no occurrence of a suspended matter in the developer in the continuous process.

Other and further objects, features, and advantages of the invention will appear more fully by reffering to the following description.

DETAILED DESCRIPTION OF THE INVENTION

The objects of the present invention have been accomplished by the method stated below. The present invention provides a method for continuously processing silver halide color photographic material with a color developer containing at least one aromatic primary amine color-developing agent, in which method a silver halide color photographic material at least one of the layers of which contains a silver halide emulsion of a high chloride comprising 80 mol % or over of silver chloride is processed, after exposeure to light, with a color developer that is substantially free from sulfite ions and whose replenishing amount is 120 ml or below per $m^2$ of the silver halide photographic material.

In the above present method, preferably the color developer is substantially free from hydroxylamine, and preferably the coating silver amount of said photographic material is 0.8 $g/m^2$ or below.

Now the present invention will be described in detail.

It is quite unexpected, in view of prior techniques, to find, in a processing method wherein a high-silver-chloride color photographic material having a silver chloride content of 80 mol % or over is used, and in which the replenishing amount of the developer is lowered, if the replenishing amount of the developer is lowered to 120 ml or below per $m^2$ of the photographic material, using a color developer substantially free from sulfite ions of the present method, that the changes in the photographic characteristics in the continuous process are remarkably improved, and that the previously-described suspended matter can be remarkably prevented from occurring in the developer.

To lower the replenishing amount of a color developer to 120 ml or below as in the present invention was not real in the prior art because of the above problems, but it has become possible by the present invention. Although the lower limit of the replenishing amount varies a little depending on the photographic material, it may be acceptable if the replenishing amount of the developer may be in the range wherein the amount of the processing solution carried over from the developing bath by the photographic material does not exceed to decrease the processing solution to make continuous processing practically impossible. Usually, a replenishing amount of 20 ml per $m^2$ of a photographic material is the amount that makes the amount of the processing solution carried over from the developing bath by the photographic material approximately equal to the replenishing amount.

The replenishing amount of the color developer of the present invention is preferably 20 ml to 120 ml, and more preferably 30 ml to 100 ml, per $m^2$ of the photographic material. The term "replenishing amount" herein means the amount of the color development replenisher to be supplied, excluding the amounts of, for example, additives for correcting the deterioration and/or condensation. Herein the term "additives" means, for example, water for diluting the condensation, preservatives susceptible to aging, or alkalis for increasing the pH.

In the practice of the present invention, it is required to use a color developer substantially free from sulfite ions. Herein the expression "color developer substantially free from sulfite ions" means a color developer containing sulfite ions in an amount of $5.0\times10^{-3}$ mol/l or below. The expression "$5.0\times10^{-3}$ mol/l" denotes the maximum value of the sulfite ion concentration in a range that does not change the photographic characteristics when a photographic material having a silver halide emulsion of a high silver chloride comprising 80 mol % or over of a silver chloride is continuously processed with the replenishing amount of the developer being 120 ml or below per $m^2$ of the photographic material.

In the present invention, more preferably the color developer contains no sulfite ions. However, in the present invention, a quite small amount of sulfite ions used to prevent the precessing kit from being oxidized, in which kit a developer is condensed before preparing therefrom an intended solution, is excluded.

The processing method of the present invention has an effect particularly on continuous processing. Herein "continuous processing" means a processing that is not a batch-processing, but is carried out continuously, by means, for example, of adding a replenisher to compensate the exhausting of the processing solution that accompanies with proceeding the developing process. It is usually to use an automatic developing machine.

It is required that the developer used in the present invention is substantially free from sulfite ions, and it is more preferable that further the developer is substantially free from hydroxylamine. This is because hydroxylamine, a preservative of developers, at the same time has an activity on the development of silver, and it is considered that a change in the concentration of hydroxylamine affects greatly the photographic characteristics. Herein, the expression "substantially free from hydroxylamine" means "containing only $5\times10^{-3}$ mol/l or below of hydroxylamine per liter of a developer."

It is required that the photographic material used in the present invention has, in at least one layer, a silver halide emulsion of a high silver chloride comprising 80 mol % or over of silver chloride, and it is quite preferable that the coating silver amount is 0.80 $g/m^2$ or below in terms of silver, in view of rapidness of the developing process and to prevent the above-mentioned occurrence of suspended matter. Further, the coating silver amount is preferably 0.3 $g/m^2$ or over, in view of image-density. From these points of view the coating amount of silver halide in terms of silver is more preferably 0.3 to 0.75 $g/m^2$, particularly preferably 0.4 to 0.7 $g/m^2$.

In the development of a high silver chloride silver halide grain, the ratio of solution physical development is high, especially higher in the latter period of development. As a result of various research, the inventors have found that the occurrence of the previously-described suspended matter in a developer relates to the dissolving speed and the solution physical development speed of unexposed silver halide grains. Further, the inventors have found that 0.8 $g/m^2$ of coating silver amount in a photographic material is the critical point of the occurence of suspended matter, such that suspended matter occurs remarkably when the coating silver amount is above 0.8 $g/m^2$, and decreases remarkably when the coating amount is 0.8 $g/m^2$ or below, preferably 0.75 $g/m^2$ or below, more preferably 0.7 $g/m^2$ or below.

The influence of coating silver amount of a photographic material on the dissolving speed of individual grains and on the speed of solution physical development was not known, further it is surprising that there is a critical point of the occurrence of suspended matter at 0.8 g/m$^2$ of coating silver amount.

It is preferable that the developer used in the present invention contain an organic preservative.

In the present invention, the term "organic preservative" means organic compounds generally that can reduce the rate of deterioration of aromatic primary amine color-developing agents when added to the processing solution for the color photographic material. That is, organic preservatives are organic compounds having a function to prevent color photographic agents from being oxidized with air or the like, and in particular, hydroxylamine derivatives (excluding hydroxylamine, the same being applied hereinafter). Particularly effective organic preservatives are, for example, hydroxamic acids, hydrazines, hydrazides, phenols, α-hydroxyketones, α-aminoketones, saccharides, monoamines, diamines, polyamines, quaternary ammonium salts, nitroxy radicals, alcohols, oximes, diamide compounds, and condensed ring-type amines. They are disclosed, for example, in JP-A Nos. 4235/1988, 30845/1988, 21647/1988, 44655/1988, 53551/1988, 43140/1988, 56654/1988, 581346/1988, and 43138/1988, European Patent Publication No. 254280, JP-A Nos. 44657/1988 and 44656/1988, U.S. Pat. Nos. 3,615,503 and 2,494,903, JP-A No. 143020/1987, and JP-B ("JP-B" means examined Japanese patent publication) No. 30496/1973.

Regarding the preferable organic preservatives mentioned above, their formulas and typical compounds are mentioned below, but the present invention is not limited to them.

It is desirable that the amount of the compounds mentioned below to be added to the color developer is 0.005 to 0.5 mol/l, and preferably 0.03 to 0.1 mol/l.

As hydroxylamine derivatives, the following are preferable:

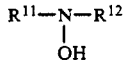

Formula (I)

wherein $R^{11}$ and $R^{12}$ each represent a hydrogen atom, a substituted or unsubstituted alkyl group, a substituted or unsubstituted alkenyl group, a substituted or unsubstituted aryl group, or a heteroaromatic group, they do not represent hydrogen atoms at the same time, and they may bond together to form a heterocyclic ring with the nitrogen atom. The ring structure of the heterocyclic ring is a 5- to 6-membered ring, it is made up of carbon atoms, halogen atoms, oxygen atoms, nitrogen atoms, sulfur atoms, etc., and it may be saturated or unsaturated.

It is preferable that $R^{11}$ and $R^{12}$ each represent an alkyl group or an alkenyl group having preferably 1 to 10 carbon atoms, more preferably 1 to 5 carbon atoms. As nitrogen-containing heterocyclic rings formed by bonding $R^{11}$ and $R^{12}$ together can be mentioned, for example, a piperidyl group, a pyrolidyl group, and N-alkylpiperazyl group, a morpholyl group, an indolinyl group, and a benztriazole group.

Preferable substituents of $R^{11}$ and $R^{12}$ are a hydroxyl group, an alkoxy group, an alkylsulfonyl group, an arylsulfonyl group, an amido group, a carboxyl group, a cyano group, a sulfo group, a nitro group, and an amino group.

Exemplified compounds:

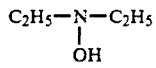

I-1

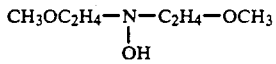

I-2

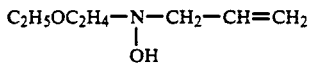

I-3

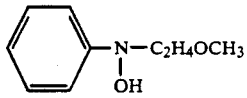

I-4

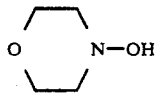

I-5

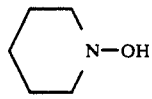

I-6

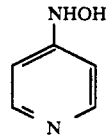

I-7

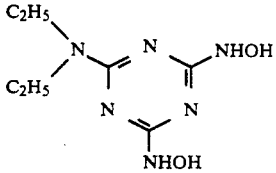

I-8

As hydroxamic acids the following compounds are preferable:

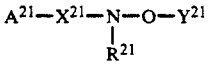

Formula (II)

wherein $A^{21}$ represents a hydrogen atom, a substituted or unsubstituted alkyl group, a substituted or unsubstituted aryl group, a substituted or unsubstituted amino group, a substituted or unsubstituted heterocyclic group, a substituted or unsubstituted alkoxy group, a substituted or unsubstituted aryloxy group, a substituted or unsubstituted carbamoyl group, a substituted or unsubstituted sulfamoyl group, an acyl group, a carboxy group, a hydroxyamino group, or a hydroxyaminocarbonyl group. As a substituent can be mentioned a halogen atom, an aryl group, an alkyl group, and an alkoxy group.

It is preferable that $A^{21}$ represents a substituted or unsubstituted alkyl group, a substituted or unsubstituted aryl group, a substituted or unsubstituted amino group, a substituted or unsubstituted alkoxy group, or a substituted or unsubstituted aryloxy group. Particularly preferable examples include a substituted or unsubstituted amino group, a substituted or unsubstituted alkoxy group, and a substituted or unsubstituted aryloxy group. The number of carbon atoms is preferably 1 to 10.

$X^{21}$ represents $$-\underset{\underset{O}{\|}}{C}-,\ -\underset{\underset{S}{\|}}{C}-,\ -SO_2-,\ \text{or}\ -SO-.$$

Preferably $X^{21}$ is $$-\underset{\underset{O}{\|}}{C}-.$$

R represents a hydrogen atom, a substituted or unsubstituted alkyl group, or a substituted or unsubstituted aryl group. $A^{21}$ and $R^{21}$ may together form a ring structure. The substituents are the same as mentioned in $A^{21}$. $R^{21}$ is preferably a hydrogen atom.

$Y^{21}$ represents a hydrogen atom or a group that can become a hydrogen atom by a hydrolysis reaction.

Exemplified compound:

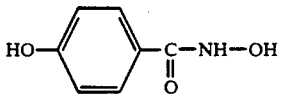
II-1

$$CH_3-\underset{\underset{O}{\|}}{C}-NH-OH$$
II-2

$$C_4H_9O-\underset{\underset{O}{\|}}{C}-NH-OH$$
II-3

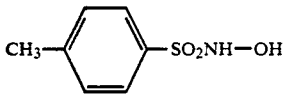
II-4

$$CH_3-\overset{CH_3}{\underset{\underset{S}{\|}}{C}}-N-OH$$
II-5

$$H_2N-\underset{\underset{O}{\|}}{C}-NH-OH$$
II-6

As hydrazines and hydrazides the following compounds are preferable:

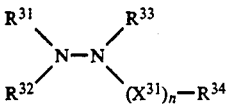
Formula (III)

wherein $R^{31}$, $R^{32}$, and $R^{33}$ each independently represent a hydrogen atom, a substituted or unsubstituted alkyl group, a substituted or unsubstituted aryl group, or a substituted or unsubstituted heterocyclic group; $R^{34}$ represents a hydroxy group, a hydroxyamino group, a substituted or unsubstituted alkyl group, a substituted or unsubstituted heterocyclic group, a substituted or unsubstituted alkoxy group, a substituted or unsubstituted aryloxy group, a substituted or unsubstituted carbamoyl group, or a substituted or unsubstituted amino group. The heterocyclic group is a 5- or 6-membered ring made up of C, H, O, N, S, and/or a halogen atom, and it may be substituted or unsubstituted. $X^{31}$ represents a divalent group selected from —CO—, $-SO_2-$, and $$-\overset{\overset{NH}{\|}}{C}-;$$

n is 0 or 1, provided that when n=0, $R^{34}$ represents a group selected from an alkyl group, an aryl group, or a heterocyclic group. $R^{33}$ and $R^{34}$ may together form a heterocyclic ring.

In formula (III), $R^{31}$, $R^{32}$, and $R^{33}$ each are preferably a hydrogen atom or an alkyl group having 1 to 10 carbon atoms, particularly $R^{31}$ and $R^{32}$ each are most preferably a hydrogen atom.

In formula (III), $R^{34}$ is preferably an alkyl group having 1 to 20 carbon atoms, an aryl group having 6 to 20 carbon atoms, an alkoxy group having 1 to 20 carbon atoms, a carbamoyl group having 1 to 20 carbon atoms, or an amino group having 0 to 20 carbon atoms, in particular preferably an alkyl group or a substituted alkyl group. The preferable substituents of an alkyl group include a carboxyl group, a sulfo group, a nitro group, an amino group, and a phosphono group. $X^{31}$ is preferably —CO— or $-SO_2-$, most preferably —CO—.

Exemplified compounds:

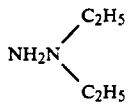
III-1

$$NH_2NH\leftarrow CH_2\rightarrow_4 SO_3H$$
III-2

$$NH_2NH\leftarrow CH_2\rightarrow_2 OH$$
III-3

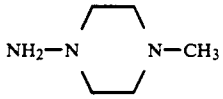
III-4

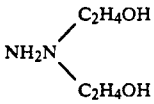
III-5

$$NH_2NHCOCH_3$$
III-6

$$NH_2NHCOOC_2H_5$$
III-7

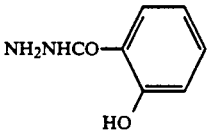
III-8

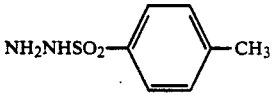
III-9

$$NH_2NHCONH_2$$
III-10

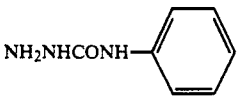
III-11

$$NH_2NHSO_3H$$
III-12

-continued

III-13 $NH_2NHC(=NH)NH_2$

III-14 $NH_2NHCOCONHNH_2$

III-15 $NH_2NHCH_2CH_2CH_2SO_3H$

III-16

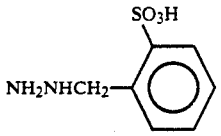

III-17 $NH_2NHCH(C_4H_9(n))COOH$

III-18 $NH_2NHCH_2CH_2COOH$

III-19

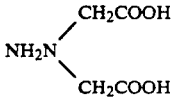

III-20

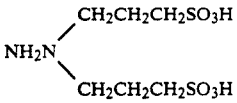

III-21

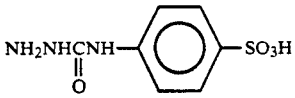

III-22

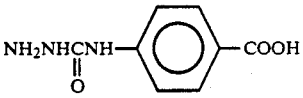

As phenols the following compounds are preferable:

Formula (IV)

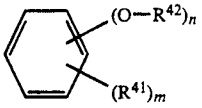

wherein $R^{41}$ represents a hydrogen atom, a halogen atom, an alkyl group, an aryl group, an alkoxy group, an aryloxy group, a carboxy group, a sulfo group, a carbamoyl group, a sulfamoyl group, an amido group, a sulfonamido group, an ureido group, an alylthio group, an arylthio group, a nitro group, a cyano group, an amino group, a formyl group, an acyl group, a sulfonyl group, an alkoxycarbonyl group, an aryloxycarbonyl group, an alkoxysulfonyl group, or a aryloxsulfonyl group. When $R^{41}$ is further substituted, as the substituent can be mentioned a halogen atom, an alkyl group, an aryl group, a hydroxyl group, and an alkoxy group. When $R^{41}$ is present 2 or more in number, they may be the same or different, and if they are adjacent, they may together form a ring. The ring structure may be a 5- or 6-membered ring, which is made up of C, H, a halogen atom, O, N, etc. They may be saturated or unsaturated. $R^{42}$ represents a hydrogen atom or a hydrolyzable group, and m and n each are integers of 1 to 5.

In formula (IV), preferably $R^{41}$ represents an alkyl group, a halogen atom, an alkoxy group, an alkylthio group, a carboxyl group, a sulfo group, a carbamoyl group, an amino group, an amido group, a sulfonamido group, a nitro group, or a cyano group. It is particularly preferable that $R^{41}$ represent an alkoxy group, an alkylthio group, an amino group, or a nitro group, which is preferably in the position ortho or para to the $(OR^{42})$ group. Preferably the number of carbon atoms of $R^{41}$ is 1 to 10, most preferably 1 to 6.

Preferably $R^{42}$ is a hydrogen atom or a hydolyzable group having 1 to 5 carbon atoms. If the $(OR^{42})$ group is present 2 or more in number, it is preferable that they are positioned ortho or para to each other.

Exemplified compounds:

IV-1

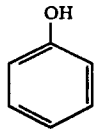

IV-2

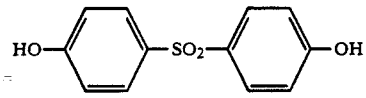

IV-3

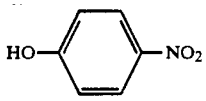

IV-4

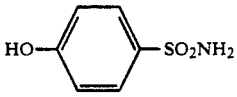

IV-5

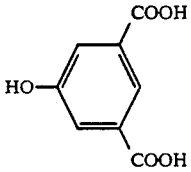

IV-6

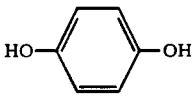

IV-7

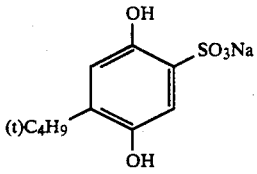

IV-8

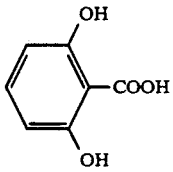

IV-9

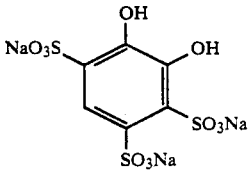

-continued

IV-10

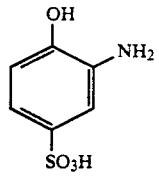

IV-11

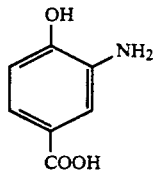

As α-hydroxyketones and α-aminoketones the following compounds are preferable:

Formula (V)

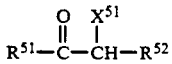

wherein $R^{51}$ represents a hydrogen atom, a substituted or unsubstituted alkyl group, a substituted or unsubstituted aryl group, a substituted or unsubstituted alkoxy group, a substituted or unsubstituted aryloxy group, or a substituted or unsubstituted amino group; $R^{52}$ represents a hydrogen atom, a substituted or unsubstituted alkyl group, or a substituted or unsubstituted aryl group; $R^{51}$ and $R^{52}$ may together form a carbocyclic ring or a heterocyclic ring; and $X^{51}$ represents a hydroxyl group or a substituted or unsubstituted amino group.

In formula (V), preferably $R^{51}$ represents a hydrogen atom, an alkyl group, an aryl group, or an alkoxy group, and $R^{52}$ represents a hydrogen atom or an alkyl group.

Exemplified compounds:

V-1

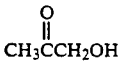

V-2

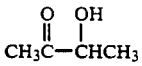

V-3

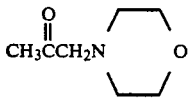

V-4

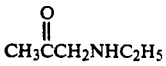

V-5

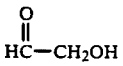

V-6

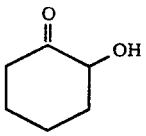

-continued

V-7

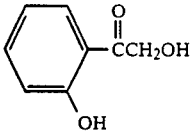

V-8

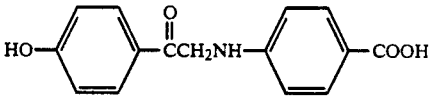

V-9

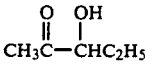

V-10

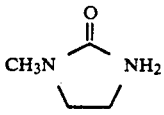

Saccharides are also preferable organic preservatives.

Saccharides (also called carbohydrate) comprise monosaccharides and polysaccharides, and many have the general formula $C_nH_{2m}O_m$. "Monosaccharides" is a term for aldehydes and ketones of polyhydric alcohols (called, respectively, aldoses and ketoses), and their derivatives, such as reduced derivatives, oxidized derivatives, and dehydrated derivatives, as well as aminosaccharides and thiosaccharides. Polysaccharides refer to products obtained by condensing two or more such monosaccharides accompanied by dehydration.

Of these saccharides, preferable are aldoses having a reducing aldehyde group and their derivatives, and more preferably those belonging to monosaccharides.

Exemplified compounds:

D-Xylose

VI-1

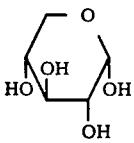

L-Arabinose

VI-2

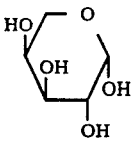

D-Ribose

VI-3

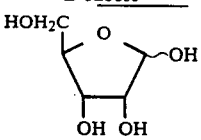

D-Deoxyribose

VI-4

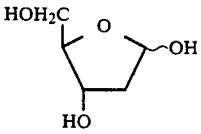

D-Glucose

-continued

VI-5

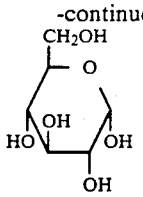

D-Galactose

VI-6

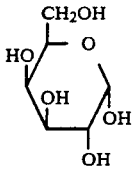

D-Mannose

VI-7

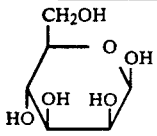

Glucosamine

VI-8

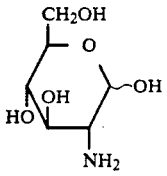

L-Sorbose

VI-9

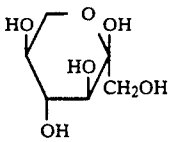

D-Sorbit (Sorbitol)

VI-10

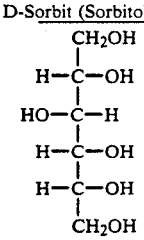

As monoamines can be mentioned:

Formula (VII)

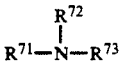

wherein $R^{71}$, $R^{72}$, and $R^{73}$ each represent a hydrogen atom, an alkyl group, an alkenyl group, an aryl group, an aralkyl group or a heterocyclic group, and $R^{71}$ and $R^{72}$, $R^{71}$ and $R^{73}$, or $R^{72}$ and $R^{73}$ may bond together to form a nitrogen-containing heterocyclic group.

$R^{71}$, $R^{72}$, and $R^{73}$ may have a substituent. Particularly preferably $R^{71}$, $R^{72}$, and $R^{73}$ each represent a hydrogen atom or an alkyl group. As a substituent can be mentioned, for example, a hydroxyl group, a sulfo group, a carboxyl group, a halogen atom, a nitro group, and an amino group.

Exemplified compounds:

VII-1 $N(CH_2CH_2OH)_3$

VII-2 $H_2NCH_2CH_2OH$

VII-3 $HN(CH_2CH_2OH)_2$

VII-4 $C_7H_{15}N(CH_2CH(OH)CH_2OH)_2$

VII-5

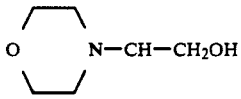

VII-6

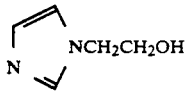

VII-7

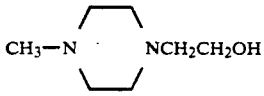

VII-8

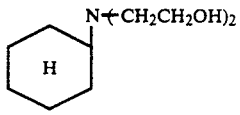

VII-9

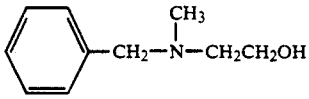

VII-10 $(HOCH_2CH_2)_2NCH_2CH_2SO_2CH_3$

VII-11 $HN(CH_2COOH)_2$

VII-12 $HOOCCH_2CH_2CH(NH_2)COOH$

VII-13 $H_2NCH_2CH_2SO_2NH_2$

VII-14

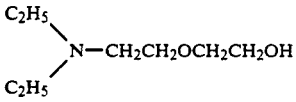

VII-15 $H_2N-C(CH_2OH)_2$

VII-16 $HOCH_2CH(NH_2)COOH$

VII-17

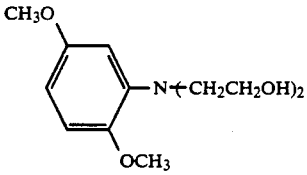

VII-18

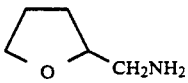

VII-19

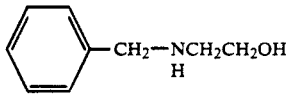

-continued

VII-20

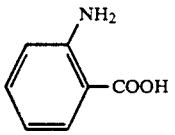

As diamines, the following are preferable:

Formula (VIII)

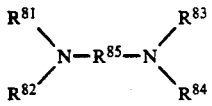

wherein $R^{81}$, $R^{82}$, $R^{83}$, and $R^{84}$ each represent a hydrogen atom, an alkyl group, an alkenyl group, an aryl group, an aralkyl group, or a heterocyclic group, and $R^{85}$ represents a divalent organic group, specifically an alkylene group, an arylene group, an aralkylene group, an alkenylene group, or a heterocyclic group.

Particularly preferably $R^{81}$, $R^{82}$, $R^{83}$, and $R^{84}$ each represent a hydrogen atom, or an alkyl group, and $R^{85}$ represents an alkylene group.

Exemplified compounds:

VIII-1

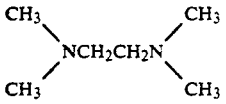

VIII-2

$(HOCH_2CH_2)_2NCH_2CH_2N(CH_2CH_2OH)_2$

VIII-3

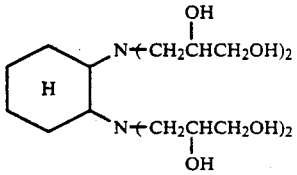

VIII-4

$H_2NCH_2CH_2N(CH_2CH_2OH)_2$

VIII-5

$H_2NCH_2CH(OH)CH_2NH_2$

VIII-6

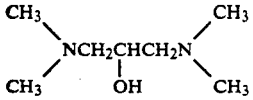

VIII-7

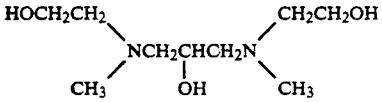

VIII-8

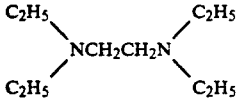

VIII-9

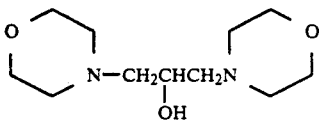

-continued

VIII-10

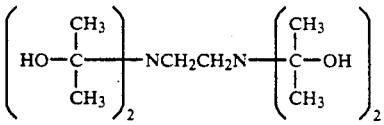

VIII-11

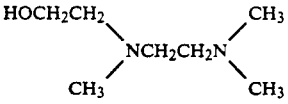

As polyamines the following are preferable:

Formula (IX)

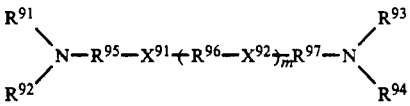

wherein $R^{91}$, $R^{92}$, $R^{93}$, and $R^{94}$ each represent a hydrogen atom, an alkyl group, an alkenyl group, an aryl group, an aralkyl group, or a heterocyclic group, $R^{95}$, $R^{96}$, and $R^{97}$ each represent a divalent organic group, and specifically have the same meaning as that of $R^{85}$ of formula (VIII), $X^{91}$ and $X^{92}$ each represent

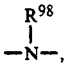

—O—, —S—, —CO—, $SO_2$—, —SO—, or a linking group formed by a combination of these linking groups, $R^{98}$ has the same meaning as that of $R^{91}$, $R^{92}$, $R^{93}$ and $R^{94}$, and m is an integer of 1 or over (there is no particular upper limit to m, and if the compound is soluble in water, the compound may have a high molecular weight, but generally m is in the range of 1 to 3).

Exemplified compounds:

IX-1

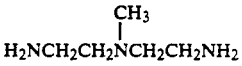

IX-2

$(HOCH_2CH_2)_2NCH_2CH_2OCH_2CH_2N(CH_2CH_2OH)_2$

IX-3

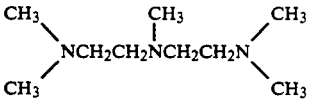

IX-4

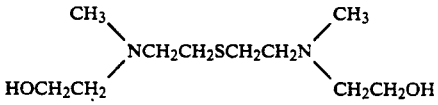

IX-5

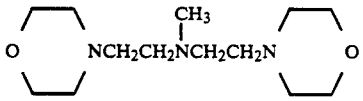

IX-6

$H_2N(CH_2CH_2NH)_nH$ n = 500 ~20,000

IX-7

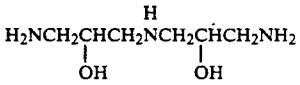

-continued

IX-8

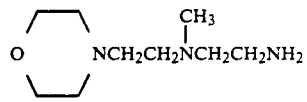

As quaternary ammonium salts, the following are preferable:

Formula (X)

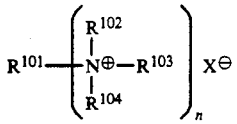

wherein $R^{101}$ represents an n-valent organic group, $R^{102}$, $R^{103}$, and $R^{104}$ each represent a monovalent organic group, which is a group having one or more carbon atoms, and specifically, for example, an alkyl group, an aryl group, or a heterocyclic group, at least two or more of $R^{102}$, $R^{103}$, and $R^{104}$ may bond together to form a heterocyclic ring containing the quaternary ammonium atom, n is an integer of 1 or over, and $X^{\ominus}$ represents a counter anion.

Particularly preferable monovalent groups of the monovalent groups represented by $R^{102}$, $R^{103}$, and $R^{104}$ are substituted or unsubstituted alkyl groups, and most preferably at least one of $R^{102}$, $R^{103}$, and $R^{104}$ is a hydroxyl group, an alkoxyalkyl group, or a carboxylalkyl group. Preferably n is an integer of from 1 to 3, more preferably 1 or 2.

Exemplified compounds:

X-1

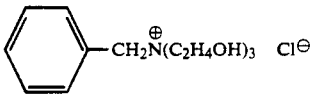

X-2

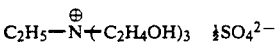

X-3

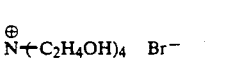

X-4

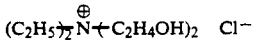

X-5

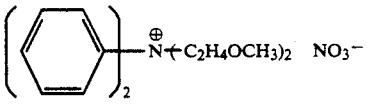

X-6

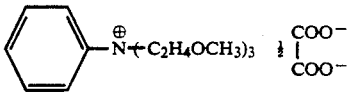

X-7

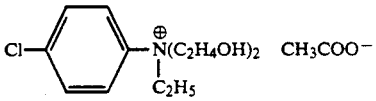

X-8

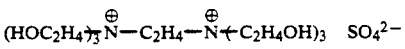

-continued

X-9

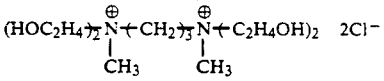

X-10

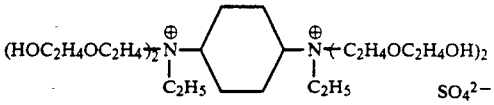

As nitroxy radicals, the following are preferable:

Formula (XI)

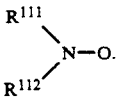

wherein $R^{111}$ and $R^{112}$ each represent a hydrogen atom, an alkyl group, an aryl group, or a heterocyclic group which may have a substituent, such as a hydroxy group, an oxy group, a carbamoyl group, an alkoxy group, a sulfamoyl group, a carboxy group, and a sulfo group. Examples of the heterocyclic group are a pyridyl group, and a piperidyl group, and preferably $R^{111}$ and $R^{112}$ each represent a substituted or unsubstituted aryl group, or a tertiary alkyl group such as a t-butyl group.

Exemplified compounds:

XI-1

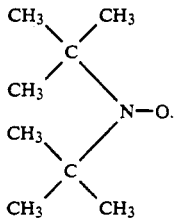

XI-2

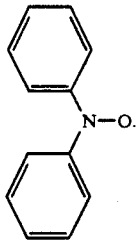

XI-3

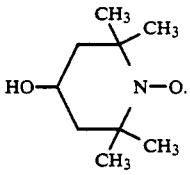

XI-4

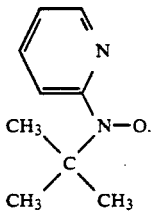

-continued

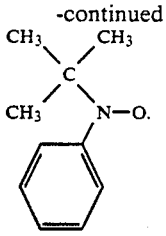

XI-5

As alcohols, the following are preferable:

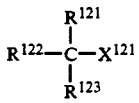

Formula (XII)

wherein $R^{121}$ represents a hydroxy-substituted alkyl group, $R^{122}$ represents an unsubstituted alkyl group or has the same meaning as that of $R^{121}$, $R^{123}$ represents a hydrogen atom or has the same meaning as that of $R^{122}$, and $X^{121}$ represents a hydroxy group, a carboxyl group, a sulfo group, a nitro group, an unsubstituted or hydroxy-substituted alkyl group, a substituted or unsubstituted amido group, or a sulfonamido group.

In formula (XII), preferably $X^{121}$ represents a hydroxy group, a carboxyl group, or a hydroxyalkyl group.

Exemplified compounds:

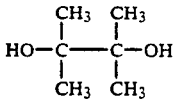

XII-1

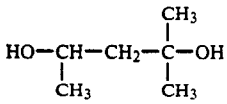

XII-2

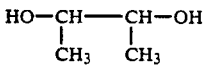

XII-3

$HO-CH(CH_2OH)_2$ XII-4

$(HO-CH_2)_3COOH$ XII-5

$C(CH_2OH)_4$ XII-6

$(HOCH_2)_3C-CH_3$ XII-7

$(HOCH_2)_3C-NHCOCH_3$ XII-8

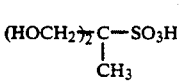

XII-9

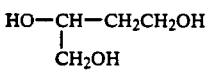

XII-10

As alcohols, the following are preferable:

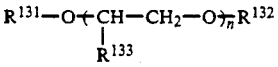

Formula (XIII)

wherein $R^{131}$, $R^{132}$, and $R^{133}$ each represent a hydrogen atom or an alkyl group, and n is a positive integer up to 500.

Preferably the alkyl group represented by $R^{131}$, $R^{132}$, and $R^{133}$ is one having 5 or less carbon atoms, more preferably 2 or less carbon atoms. It is very preferable that $R^{131}$, $R^{132}$, and $R^{133}$ each represent a hydrogen atom or a methyl group, with a hydrogen atom most preferred.

Preferably, n is a positive integer of 100 or below, more preferably as low as 3 or as high as 30.

Exemplified compounds:

$HO(CH_2CH_2O)_4OH$ XIII-1

$CH_3O(CH_2CH_2O)_3OH$ XIII-2

$CH_3O(CH_2CH_2O)_2OCH_3$ XIII-3

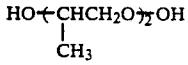

XIII-4

$HOCH_2CH_2OCH_3$ XIII-5

$C_2H_5O(CH_2CH_2O)_2OH$ XIII-6

$HO(CH_2CH_2O)_nH$ XIII-7
av. molecular weight: about 300

$HO(CH_2CH_2O)_nH$ XIII-8
av. molecular weight: about 800

$HO(CH_2CH_2O)_nH$ XIII-9
av. molecular weight: about 3000

$HO(CH_2CH_2O)_nH$ XIII-10
av. molecular weight: about 8000

As oximes, the following are preferable:

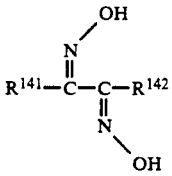

Formula (XIV)

wherein $R^{141}$ and $R^{142}$, which may be the same or different, each represent a hydrogen atom, a substituted or unsubstituted alkyl group, or a substituted or unsubstituted aryl group, and $R^{141}$, and $R^{142}$ may bond together.

In formula (XIV), preferably $R^{141}$ and $R^{142}$ each represent an alkyl group that may be substituted by a halogen atom, a hydroxyl group, an alkoxy group, an amino group, a carboxyl group, a sulfo group, a phosphonic acid group, or a nitro group.

Preferably the sum of the carbon atoms in formula (XIV) is 30 or below, and more preferably 20 or below.

Exemplified compounds:

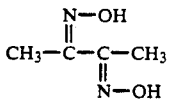

XIV-1

-continued

XIV-2

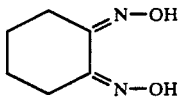

XIV-3

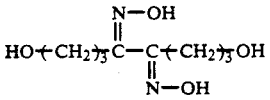

XIV-4

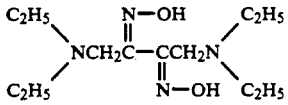

XIV-5

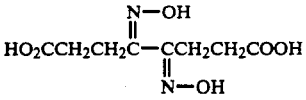

As polyamines, the following are preferable:

Formula (XV)

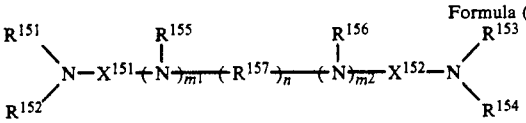

wherein $X^{151}$ and $X^{152}$ each represent —CO— or —$SO_2$, $R^{151}$, $R^{152}$, $R^{153}$, $R^{154}$, and $R^{156}$ each represent a hydrogen atom or a substituted or unsubstituted alkyl group, $R^{157}$ represents a substituted or unsubstituted alkylene group, a substituted or unsubstituted arylene group, or a substituted or unsubstituted aralkylene group, and $m^1$, $m^2$, and n each are 0 or 1.

Exemplified compounds:

XV-1

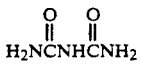

XV-2

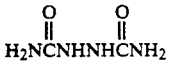

XV-3

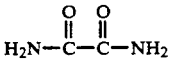

XV-4

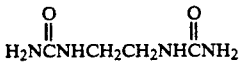

XV-5

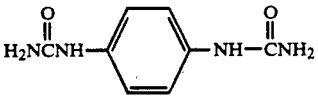

XV-6

$H_2NSO_2NHSO_2NH_2$

As amines having a condensed ring the following compounds are preferable:

Formula (XVI)

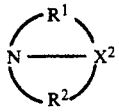

wherein X represents a trivalent group of atoms necessary to complete a condensed ring, and $R^1$ and $R^2$ each represent an alkylene group, an arylene group, an alkenylene group, or an aralkylene group.

$R^1$ and $R^2$ may be the same or different.

Of the compounds represented by formula (XVI), particularly preferable compounds are those represented by formulas (1-a) and (1-b):

Formula (1-a)

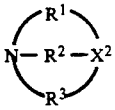

wherein $X^1$ represents

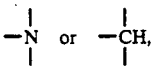

$R^1$ and $R^2$ have the same meaning as defined above for formula (XVI), and $R^{13}$ has the same meaning as $R^1$ or $R^2$ or represents

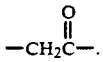

In formula (1-a), preferably $X^1$ represents

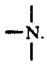

Preferably the number of carbon atoms of $R^1$, $R^2$, and $R^3$ is 6 or below, more preferably 3 or below, and most preferably 2.

Preferably $R^1$, $R^2$, and $R^3$ each represent an alkylene group or an arylene group, most preferably an alkylene group.

Formula (1-b)

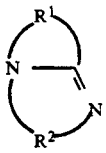

wherein $R^1$ and $R^2$ have the same meaning as defined in formula (XVI).

In formula (1-b), preferably the number of carbon atoms of $R^1$ and $R^2$ is 6 or below. Preferably $R^1$ and $R^2$ each represent an alkylene group or an arylene group, most preferably an alkylene group.

Of compounds represented by formulae (1-a) and (1-b), those represented by formula (1-a) are preferable.

XVI-1

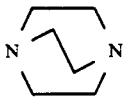

-continued

XVI-2

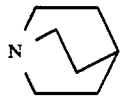

XVI-3

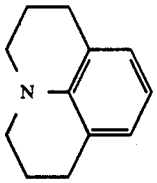

XVI-4

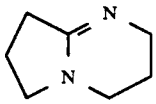

XVI-5

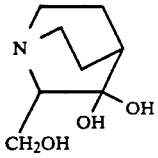

XVI-6

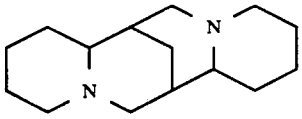

XVI-7

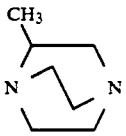

XVI-8

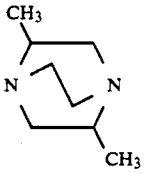

XVI-9

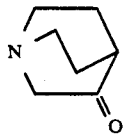

XVI-10

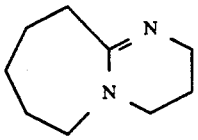

XVI-11

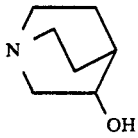

-continued

XVI-12

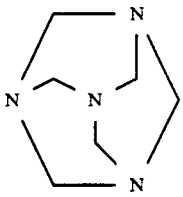

XVI-13

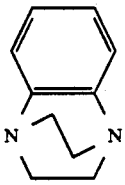

XVI-14

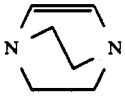

XVI-15

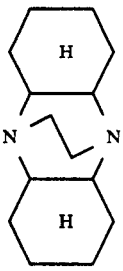

XVI-16

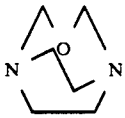

XVI-17

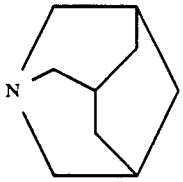

XVI-18

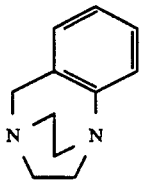

Many of the compounds represented by formula (XVI) according to the present invention are readily available commercially.

In the above-described formulas (I) to (XVI), except the case particularly denoted, the number of carbon atoms of the aliphatic substituents (e.g., an alkyl or an alkenyl) or the groups containing them is preferably 1 to 10, more preferably 1 to 6, and the number of carbon atoms of the aromatic substituents (e.g., an aryl) or the group containing them is preferably 1 to 8, more preferably 1 to 5.

Two or more of the above-mentioned preservatives can be used in combination. Preferable combinations include that of at least one compound represented by formulas (I) to (VI) and at least one compound represented by formulas (VII) to (XVI).

More preferable combinations to use are that of at least one compound represented by formula (I) or (III) and at least one compound represented by formula (VII) or (XVI).

It is more preferably in view of preventing the occurrence of the above-mentioned suspended matter in the developer that a photographic material-applied silver halide emulsion in a coating amount of 0.8 g/m$^2$ or below in terms of silver is subjected to a developing process using a color-developer that contains the above-described organic preservative represented by formula (I) or (III).

Although the role of an organic preservative in the prevention of suspended matter is not clear, it is presumed that the silver halide-dissolvability, the silver-development-activity, and the reducing ability of the organic preservative may be concerned.

In the present invention, which is required to use the color-developer not containing sulfite ion substantialy, in order to restrain the deterioration of the developer, physical means, for example, to not use the developer for a long time, and to use a floating cover or to decrease the opened surface-ratio in the developing bath to impede the effect of oxydation by air, and chemical means, for example, to control the temperature of the developer, and to add an organic preservative, may be employed. Of these means, the method of using an organic preservative is advantageous in view of convenience.

The color-developing solution for use in the present invention is described below.

The color-developing solution for use in the present invention may contain a known aromatic primary amine color-developing agent. Preferred examples are p-phenylenediamine derivatives. Representative examples are given below, but they are not meant to limit the present invention:

D-1: N,N-Diethyl-p-phenylenediamine

D-2: 4-[N-Ethyl-N-(β-hydroxyethyl)amino]aniline

D-3: 2-Methyl-4-[N-ethyl-N-(β-hydroxyethyl-)amino]aniline

D-4: 4-Amino-3-methyl-N-ethyl-N-(β-methanesulfonamido ethyl)aniline

These p-phenylenediamine derivatives may be in the form of salts, such as sulfates, hydrochloride, sulfites, and p-toluenesulfonates. The amount of said aromatic primary amine developing agent to be used is preferably about 0.1 g to about 20 g, more preferably about 0.5 g to about 10 g, per liter of developer.

Preferably the pH of the color-developer of the present invention is in the range of 9 to 12, more preferably 9 to 11.0, and other known compounds that are components of a conventional developing solution can be contained.

To maintain the above-mentioned pH-value, it is preferable to use various buffer agents. Examples of buffer agents that can be mentioned include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salycylate), potassium o-hydroxybenzoate, sodium 5-sulfo-2-hydroxybenzoate (sodium 5-sulfosalycylate), and potassium 5-sulfo-2-hydroxybenzoate (potassium 5-sulfosalycylate).

Preferably the amount of buffer agent to be added is 0.1 mol/liter or over, more preferably 0.1 to 0.4 mol/liter.

In addition, various chelating agents may also be used in the color-developer, as a suspension agent for calcium and magnesium or for improving the stability of the color-developer.

Specific examples will be given below. The present invention, however, is not limited to them:

Nitrilotriacetic acid
Diethylenetriaminepentaacetic acid
Ethylenediaminetetraacetic acid
Triethylenetetraminehexaacetic acid
N,N,N-trimethylenephosphonic acid
Ethylenediamine-N,N,N',N'-tetramethylenephosphonic acid
1,3-Diamino-2-propanoltetraacetic acid
Transcyclohexanediaminetetraacetic acid
Nitrilotripropionic acid
1,2-Diaminopropanetetraacetic acid
Hydroxyethyliminodiacetic acid
Glycoletherdiaminetetraacetic acid
Hydroxyethylenediaminetriacetic acid
Ethylenediamineorthohydroxyphenylacetic acid
2-Phosphonobutane-1,2,4-tricarboxylic acid
1-Hydroxyethylidene-1,1-diphosphonic acid
N,N'-Bis(2-hydroxybenzyl)ethylenediamine-N,N'-diacetate.

These chelating agents may, if necessary, be used in a combination of two or more compounds.

These chelating agents may each be added in an amount sufficient to sequester metal ions in the color-developer for example, in an amount of about 0.1 g to 10 g per liter of color-developer.

An arbitrary development accelerator may, if needed, be added to the color-developer.

As a development accelerator, each one of thioether compounds disclosed, for example, in JP-B Nos. 16088/1962, 5987/1962, 7826/1963, 12380/1969, and 9019/1970, and U.S. Pat. No. 3,813,247; p-phenylenediamine compounds disclosed in JP-A Nos. 49829/1977 and 15554/1975; quaternary ammonium salts disclosed in JP-A No. 137726/1975, JP-B No. 30074/1969, and JP-A Nos. 156826/1981 and 43429/1977; p-aminophenols described in U.S. Pat. Nos. 2,610,122 and 4,119,462; amine compounds described in U.S. Pat. Nos. 2,494,903, 3,128,182, 4,230,796, and 3,253,919, JP-B No. 11431/1966, and U.S. Pat. Nos. 2,482,546, 2,596,926, and 3,582,346; polyalkyleneoxides described in JP-B Nos. 16088/1962 and 25201/1967, U.S. Pat. No. 3,128,183, JP-B Nos. 11431/1966 and 23883/1967, and U.S. Pat. No. 3,532,501; 1-phenyl-3-pyrazolydones; hydrazines; mesoionic-type compounds; ionic type compounds; and imidazoles may be added as needed.

It is preferable that the color-developer of the present invention be substantially free of benzyl alcohol. Herein the term "substantially free of benzyl alcohol" means that the amount of benzyl alcohol per liter of color developer is no more than 2 ml, but more preferably benzyl alcohol should not be contained at all.

In the present invention an arbitrary antifoggant may be added if required. Antifoggants that can be added include alkali metal halides, such as sodium chloride, potassium bromide, potassium iodide, and organic antifoggants. Representative examples of organic antifoggants include nitrogen-containing heterocyclic compounds such as benzotriazole, 6-nitrobenzimidazole, 5-nitrobenzotriazole, 5-chloro-benzotriazole, 2-thiazolylbenzimidazole, 2-thiazolyl-methylbenzimidazole, indazoles, hydroxyazindolizine, and adenine.

It is preferable that the color-developer of the present invention contain a fluorescent brightening agent. As a fluorescent brightening agent, 4,4'-diamino-2,2'-disulfostilbene compounds are preferable. The amount of addition is in the range of 0 to 5 g/l, preferably 0.1 to 4 g/l.

Further, surface-active agents, such as alkylsulfonic acids, aliphatic acids, and aromatic carboxylic acids, may be added as needed.

The processing temperature using the color-developer of this invention is between 20° to 50° C., preferably 30° to 40° C. The processing time is between 20 sec. to 5 min., preferably 30 sec. to 2 min.

In this invention, a desilvering process is carried out following a color-developing process. The desilvering process consists usually of a bleaching process and a fixing process, which may be carried out at the same time.

The bleaching solution or the bleach-fixing solution used in the present invention may contain a rehalogenating agent, such as a bromide (e.g., potassium bromide, sodium bromide, and ammonium bromide), a chloride (e.g., potassium chloride, sodium chloride, and ammonium chloride) or an iodide (e.g., ammonium iodide). If needed, one or more inorganic acids or organic acids and their metal salts or ammonium salts having a pH-buffering effect can be added, such as boric acid, borax, sodium metaborate, acetic acid, sodium acetate, sodium carbonate, potassium carbonate, phosphorous acid, phosphonic acid, sodium phosphate, citric acid, sodium citrate, and tartaric acid; or a corrosion inhibitor such as guanidine or ammonium nitrate can also be added.

The fixing agent used in the bleach-fixing solution or the fixing solution of the present invention can be a known fixing agent. That is, a dissolving agent of water-soluble silver halide, such as, for example, a thiosulfate-like sodium thiosulfate or ammonium thiosulfate; a thiocyanate such as sodium thiocyanate or ammonium thiocyanate; a thioether compound such as ethylenebisthioglycolic acid or 3,6-dithia-1,8-octanediol; or a thiourea. Two or more of these compounds may be combined. Further, a specific bleach-fixing solution, for example consisting of a fixing agent and a large amount of halide compound such as potassium iodide, described in JPA No. 155354/1980, may be used. In the present invention it is preferable to use a thiosulfate, particularly ammonium thiosulfate. The amount of fixing agent to be used per liter of the bath is preferably in the range of 0.3 to 2 mol, more preferably 0.5 to 1.0 mol.

The pH range of the bleach-fixing solution or the fixing solution is preferably in the range of 3 to 10, more preferably 5 to 9. If the pH-value is in below the range, the desilvering property will be improved, but the deterioration of the solution and the leucozation of cyandye will be accelerated. On the contrary, if the pH-value is in higher the range, the desilvering rate will be lowered, and stain will occur.

To adjust pH, hydrochloric acid, sulfuric acid, nitric acid, acetic acid, hydrocarbonate, ammonia, potassium hydroxide, sodium hydroxide, sodium carbonate or potassium carbonate may be added, as need.

Further, the bleach-fixing solution can contain a brightening agent, an antiformer, a surface-active agent, or an organic solvent such as polyvinylpyrolidone and methanol.

The bleach-fixing solution or the fixing solution in the present invention contains, as a preservative, a sulfite ion-releasing compound, such as a sulfite (e.g., sodium sulfite, potassium sulfite, and ammonium sulfite), a bisulfite (e.g., ammonium bisulfite, sodium bisulfite, and potassium bisulfite), or a metabisulfite (e.g., potassium metabisulfite, sodium metabisulfite, and ammonium metabisulfite). The amount of these compounds to be added is preferably about 0.02 to 0.5 mol/l, more preferably 0.04 to 0.40 mol/l, in terms of sulfite ion.

Although a sulfite is generally added as a preservative, others, such as ascorbic acid, carbonylbisulfite adducts, sulfite acid, and carbonyl compounds, may be added.

Further, there may be added, if required, a buffering agent, brightening agent, chelating agent, or antifungal agent.

The silver halide color photographic material used in the present invention is generally passed through a washing step and/or a stabilizing step after the desilvering process of fixing or bleach-fixing.

The amount of washing water in the washing step can be set over a wide range, depending on the properties of the photographic material (for example, due to the material used, such as couplers), the uses of the photographic material, the temperature of the washing water, the number of washing tanks (number of steps), the type of replenishing mode, such as counter-current mode or concurrent mode, and other conditions. The relationship between the number of washing tanks and the amount of water in the multistage counter-current mode can be determined by a method described in *Journal of the Society of Motion Picture and Television Engineers*, Vol. 64, pp. 248–253 (May, 1955).

With the multistage counter-current method described in the above-mentioned literature, the amount of washing water can be decreased considerably. However, bacteria propagate due to the increased time the water remains in the tanks, causing such problems as the adhesion of resulting suspended matter on the photographic material. To solve such problems in the present method of processing a color photographic material, a method of decreasing calcium and magnesium described in JP-A No. 288838/1987 can be used very effectively. Further, agents that can be used include isothiazolone and cyabendazole compounds described in JP-A No. 8542/1982, chlorine-type bactericides such as sodium chlorinated isocyanurate, benzotriazole, and other bactericides in Hiroshi Horiguchi *Bokinbobai no Kagaku, Sakkin, Bobai Gijutsu,* edited by Eiseigijutsu kai, and *Bokinbobaizai Jiten,* edited by Nihon Bokinbobai-gakkai.

The pH range of the washing water in the processing steps for the photographic material of the present invention may be 4 to 9, preferably 5 to 8. The temperature and time of washing, which can be set according to the use or property of the photographic material, is generally in the range 15° to 45° C. and 20 sec. to 10 min., preferably 25° to 40° C. and 30 sec. to 5 min.

Further, the photographic materials of the present invention can be processed directly by a stabilizing solution without a washing step. In such a stabilizing process, all known methods described, for example, in JP-A Nos. 8543/1982, 14834/1983, 184343/1984, 220345/1985, 238832/1985, 239784/1985, 239749/1985, 4045/1986, and 118749/1986 can be used. A preferred inclusion is to use a stabilizing bath containing 1-hydroxyethylidene-1, 1-diphosphonate, 5-chloro-2-methyl-4-isothiazoline-3-one, a bismuth compound, or an ammonium compound.

In some cases a stabilizing process is carried out following the above-described washing process, and an example of such cases is a stabilizing bath containing formalin and a surface-active agent for use as a final bath for color photographic materials for photographing.

Next, details of the silver halide color photographic material for use in the present invention will be described below.

The silver halide emulsion of the present invention is composed substantially of silver chloride. Herein the term "substantially" means that the content ratio of silver chloride in total silver halide is 80 mol % or more, preferably 95 mol % or more and 99.9 mol % or below, more preferably 98 mol % or more. In view of rapid processing, the higher the content of silver chloride the more preferable. Small amounts of silver bromide and/or silver iodide may be contained in the high-silver chloride emulsion of the present invention. In these cases, many useful effects on photo-sensitivity can be obtained, to increase the amount of light-absorption, increase the adsorption of spectrally-sensitizing dye, and to decrease the desensitization due to spectrally-sensitizing dye.

In the present invention, preferably the blue-sensitive layer, the green-sensitive layer, and the red-sensitive layer are silver halide emulsion layers comprising high silver chloride emulsion.

The silver halide grains contained in the silver halide emulsions of the photographic materials to be used in the present invention may be of such a structure that the internal phase differs from the surface phase, the entire grains may have a uniform phase, they may be polyphase with a joining structure, or a mixture thereof.

The silver halide grains in the photographic emulsions may have a regular crystal structure such as cubic, octahedral, or tetradecanhedral, an irregular crystal such as spherical or tabular, a crystal having crystal defects such as twin planes, or a thereof composite crystal structure.

The grain size of the silver halide may be fine grains having a diameter of about 0.2 μm or less, or coarse grains with the diameter of the projected area being down to 10 μm, and a polydisperse emulsion or a monodisperse emulsion can be used.

A monodisperse emulsion is preferable, particularly silver chloride emulsion layers of all comprising monodisperse emulsions are preferable for the purpose of the present invention. Two or more monodisperse emulsions may be mixed in an emulsion layer.

Herein, as a monodisperse emulsion, it is preferable that s/r (wherein r represents an average grain size and s represents a standard deviation of grain size distribution) is 0.2 or below, more preferably 0.15 or below.

The silver halide photographic emulsion for use in the present invention can be prepared by the process described, for example, in *Research Disclosure* (RD) No. 17643 (December, 1978), pp. 22–23, "*I. Emulsion Preparation and Types*".

A monodisperse emulsion described, for example, in U.S. Pat. Nos. 3,574,628 and 3,655,394, and British Patent No. 1,413,748 is also preferably.

Tabular grains having an repect ratio of 5 or more can be used in the present invention. Tabular grains may be easily prepared by suitably using the methods described, for example, in Gutoff :*Photographic Science and Engineering*, Vol. 14, pp. 248–257 (1970): U.S. Pat. Nos. 4,434,226, 4,414,310, 4,433,048, and 4,439,520; and British Patent No. 2,112,157.

The crystal structure may be uniform, the outer halogen composition may be different from the inner halogen composition, or the crystal structure may be layered. The halide composition may be joined by the epitaxial joint to a different silver halide composition or a compound other than silver halides, for example, silver rhodanide or lead oxide, is jointed.

Further, a mixture of different crystal structures can be used.

Generally, the emulsion to be used in the present invention may be physically ripened, chemically ripened, and spectrally sensitized. Additives to be used in these steps are described in *Research Disclosure* Nos. 17643 and 18716, and the involved sections are listed in the Table below.

Known photographic additives that can be used in the present invention are also described in the above-mentioned two Research Disclosures, and the involved sections are listed in the same Table.

| | Additive | RD 17643 | RD 18716 |
|---|---|---|---|
| 1 | Chemical sensitizer | p. 23 | p. 648 (right column) |
| 2 | Sensitivity-enhancing agents | " | " |
| 3 | Spectral sensitizers, Supersensitizers | pp. 23–24 | pp. 648 (right column)–649 (right column) |
| 4 | Brightening agents | p. 24 | — |
| 5 | Antifogging agents and Stabilizers | pp. 24–25 | p. 648 (right column) |
| 6 | Light absorbers, Filter dyes and UV absorbers | pp. 25–26 | pp. 649 (right column)–650 (right column) |
| 7 | Stain-preventive agents | p. 25 (right column) | p. 650 (left to right column) |
| 8 | Image-dye stabilizers | p. 25 | — |
| 9 | Hardeners | p. 26 | p. 651 (left column) |
| 10 | Binders | p. 26 | " |
| 11 | Plasticizers and Lubricants | p. 27 | p. 650 (right column) |
| 12 | Coating aids and Surface-active agents | pp. 26–27 | " |
| 13 | Antistatic agents | p. 27 | " |

Various color couplers may be used in the present invention, and typical examples thereof are described in the patents cited in *Research Disclosure* (RD) No. 17643, VII-C - G.

As yellow couplers, those described, for example, in U.S. Pat. Nos. 3,933,501, 4,022,620, 4,326,024, and 4,401,752, JP-B No. 10793/1983, and British Patent Nos. 1,425,020 and 1,476,760 may be used preferably.

Of these, acetoamide derivatives such as benzoyl acetoanilide and pivaloyl acetoanilide are preferable.

In particular, compounds represented by the following formulas (Y-1) and (Y-2) are preferable as a yellow coupler:

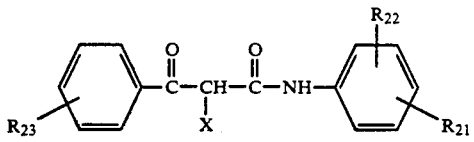

(Y-1)

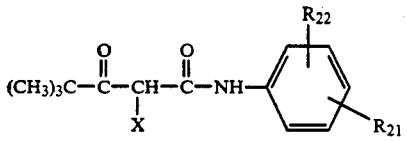

(Y-2)

wherein X represents a hydrogen atom or coupling split-off group (particularly nitrogen split-off groups are preferably than oxygen split-off groups); $R_{21}$ represents a non-diffusion group having totally 8 to 32 carbon atoms; $R_{22}$ represents a hydrogen atom, one or more halogen atoms, a lower alkyl group, a lower alkoxy group, or a non-diffusion group having totally 8 to 32 carbon atoms; $R_{23}$ represents a hydrogen atom or a substituent; and when $R_{22}$ is two or more in number they may be the same or different.

Details of pivaloyl acetoanilide-type yellow couplers are described, for example, in U.S. Pat. Nos. 4,622,287 (from column 3 line 15 to column 8 line 39 of the specification) and 4,623,616 (from column 14 line 50 to column 19 line 41).

Details of benzoyl acetoanilide-type yellow couplers are described, for example, in U.S. Pat. Nos. 3,408,194, 3,933,501, 4,046,575, 4,133,958, and 4,401,752.

As magenta couplers, the 5-pyrazolone type and pyrazoloazole type are preferable, and those described, for example, in U.S. Pat. Nos. 4,310,619 and 4,351,897, European Patent No. 73,636, U.S. Pat. Nos. 3,061,432 and 3,725,067, *Research Disclosure* No. 24220 (June, 1984), JP-A No. 33552/1985, *Research Disclosure* No. 24230 (June, 1984), JP-A No. 43659/1985, and U.S. Pat. Nos. 4,500,630 and 4,540,654 are particularly preferable.

As cyan couplers can be mentioned phenol couplers and naphthol couplers, and those described, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent (OLS) No. 3,329,729, European Patent No. 121,365A, U.S. Pat. Nos. 3,446,622, 4,333,999, 4,451,559, and 4,427,767, and European Patent No. 161,626A are preferable.

As a colored coupler to rectify the unnecessary absorption of color-forming dyes, those couplers described in paragraph VII-G of *Research Disclosure* No. 17643, U.S. Pat. No. 4,165,670, JP-B No. 39413/1982, U.S. Pat. Nos. 4,004,929 and 4,138,258, and British Patent No. 1,146,368 are preferable.

As a coupler which forms a dye having proper diffusibility, those described in U.S. Pat. No. 4,366,237, British Patent No. 2,125,570, European Patent No. 96,570, and West German Patent Application (OLS) No. 3,234,533 are preferable.

Typical examples of a polymerized dye-forming coupler are described in U.S. Pat. Nos. 3,451,820, 4,080,211, and 4,367,282, and British Patent No. 2,102,173.

A coupler that releases a photographically useful residue can be used favorably in this invention. As a DIR coupler that releases a development retarder, those described in patents cited in paragraph VII-F of the above-mentioned *Research Disclosure* No. 17643, JP-A Nos. 151944/1982, 154234/1982, and 184248/1985, and U.S. Pat. No. 4,248,962 are preferable.

As a coupler which releases, imagewise, a nucleating agent or a development accelerator upon developing, those described in British Patent Nos. 2,097,140 and 2,131,188, and JP-A Nos. 157638/1984 and 170840/1984 are preferable.

Other couplers that can be incorporated in the photographic material of this invention include competitive couplers described in U.S. Pat. No. 4,130,427, multiequivalent couplers described in U.S. Pat. Nos. 4,283,472, 4,338,393, and 4,310,618, DIR couplers that release a redox compound, as described, for example, in JP-A No. 185950/1985, and couplers that release a dye to regain a color after releasing, as described in European Patent No. 173,302A.

The couplers to be used in this invention can be incorporated to photographic materials by various known dispersing processes.

Examples of a high-boiling organic solvent for use in the oil-in-water dispersing process are described, for example, in U.S. Pat. No. 2,332,027.

The steps and effects of the latex dispersion method and examples of latex for impregnation are described, for example, in U.S. Pat. No. 4,199,363 and West German Patent Application (OLS) Nos. 2,541,274 and 2,541,230.

Suitable support substrates for use in this invention are described, for example, on page 28 of the above-mentioned RD. No. 17643, and on the right column of page 627 to the left column of page 648 in RD. No. 18716.

According to the method of this invention, it is possible to attain an excellent effect that the replenishing amount of a color-developer in a developing process is lowered remarkably without marring the rapidness of the process, and a continuous developing process can be carried out wherein the photographic characteristics, in particular the minimum density, the maximum density, and the gradation, change less. Further, according to this invention, by using a high silver chloride photographic material, a developing process wherein the replenishing amount of a color-developer is lowered remarkably and suspended matter does not appear in the developer as a continuous process is carried out.

The invention will now be described in further detail with reference to examples, but the invention is not limited to the following examples.

EXAMPLE 1

A multilayer color photographic paper A was prepared by coating layers as hereinbelow described on a paper laminated on both sides with polyethylene.

Coating solutions were prepared by mixing and dissolving a emulsion, each of chemicals, and an emulsified dispersion, of which each preparation procedure is described below.

PREPARATION OF THE COUPLER EMULSION

To a mixture of 19.1 g of yellow coupler (ExY) and 4.4 g of an image-dye stabilizer (Cpd-1), 17.2 m of ethyl acetate and 7.7 g of a solvent (Solv-1) were added and dissolved. The resulting solution was emulsified and dispersed in 185 m of 10% gelatin solution containing 8 of sodium dodecylbenzensulfonate.

According to this procedure each emulsion of magenta coupler, cyan coupler, and intermediate layer was prepared.

The compounds used for each emulsion were as follows:

Yellow coupler
(ExY)

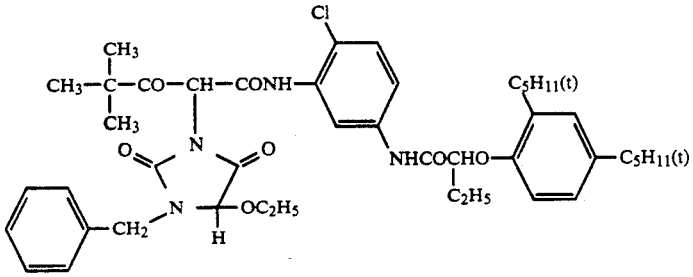

Magenta coupler
(ExM)

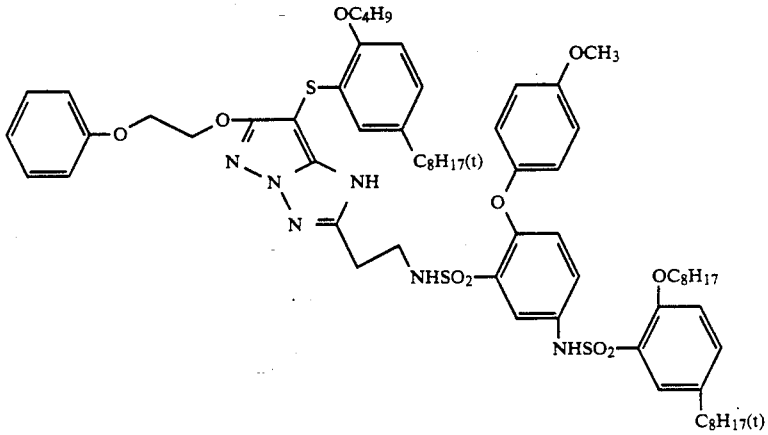

Cyan coupler
(ExC$_1$)

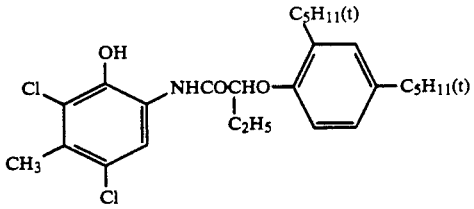

(ExC$_2$)

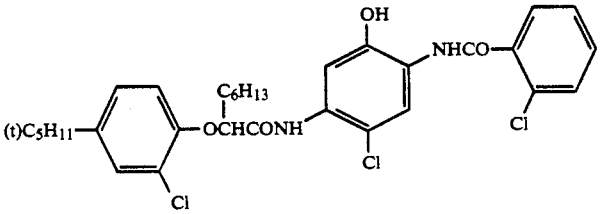

Image-dye stabilizer
(Cpd-1)

-continued
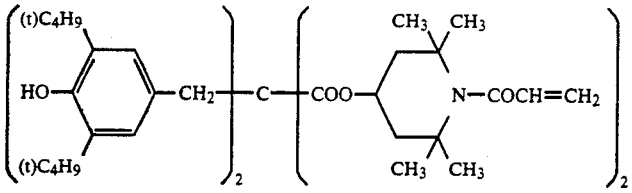
Color-mix inhibitor
(Cpd-2)
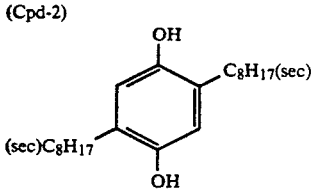
(Cpd-3)
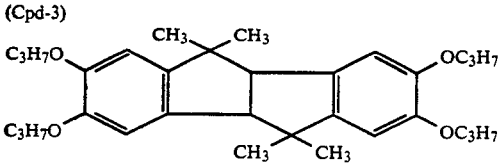
(Cpd-4)
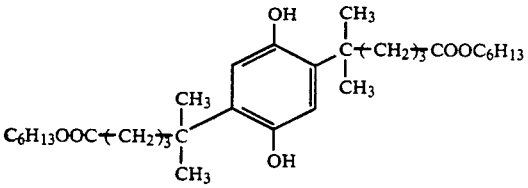
Color-mix inhibitor
(Cpd-5)
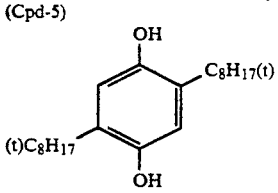
Image-dye stabilizer
(Cpd-6)
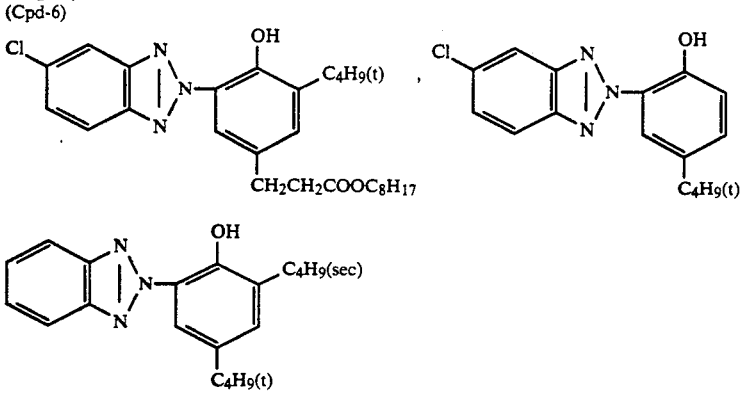
(Mixture of 5:8:9 in weight ratio)
Polymer
(Cpd-7)
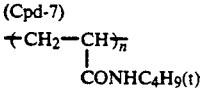
(av. molecular weight: 80,000)
UV absorber
(UV-1)

-continued

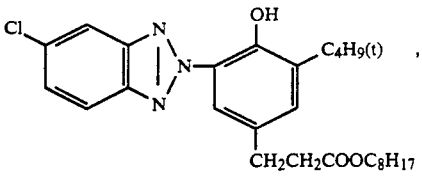

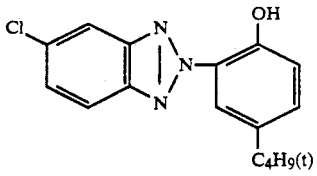

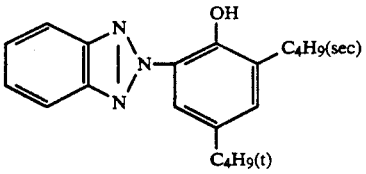

(Mixture of 2:9:8 in weight ratio)

Solvent
(Solv-1)

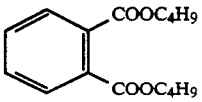

Solvent
(Solv-2)
$O{=}P{\leftarrow}O{-}C_8H_{17})_3$

Solvent
(Solv-3)
$O{=}P{\leftarrow}O{-}C_9H_{19}(iso))_3$

Solvent
(Solv-4)

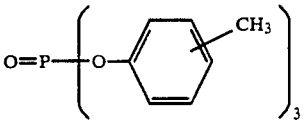

The following dyes were used to prevent the respective emulsion layer from irradiation:

Red-sensitive emulsion layer

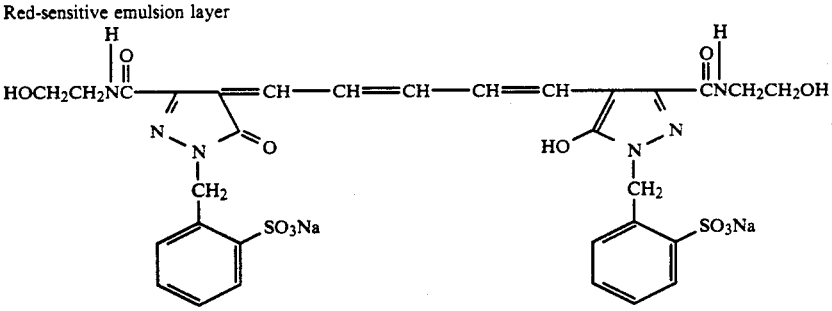

Green-sensitive emulsion layer

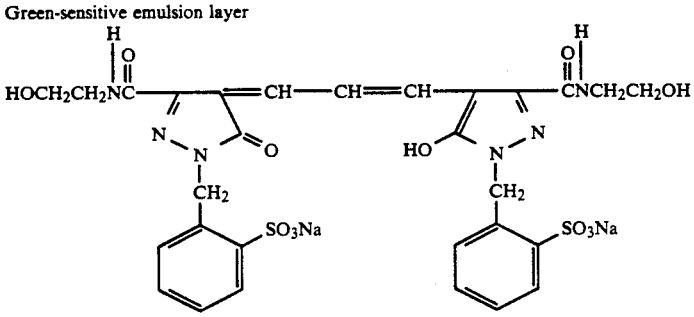

To the red-sensitive emulsion layer, the following compound was added in an amount of $2.6\times10^{-3}$ mol per mol of silver halide.

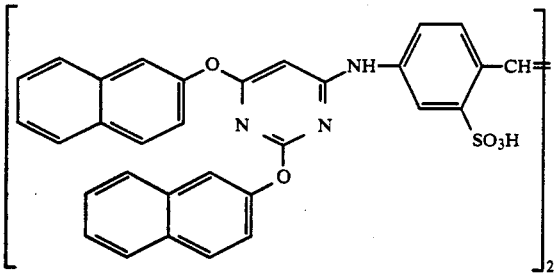

Next, the preparation procedure of emulsions used in this example will be described below.

| Blue-sensitive emulsion | |
|---|---|
| (1st solution) | |
| $H_2O$ | 1000 ml |
| NaCl | 5.5 g |
| Gelatin | 32 g |
| (2nd solution) | |
| Sulfuric acid (1N) | 24 ml |
| (3rd solution) | |
| Compound A shown below (1%) | 3 ml |

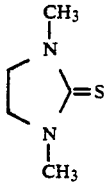

| | |
|---|---|
| (4th solution) | |
| NaCl | 1.7 g |
| $H_2O$ to make | 200 ml |
| (5th solution) | |
| $AgNO_3$ | 5 g |
| $H_2O$ to make | 200 ml |
| (6th solution) | |
| NaCl | 41.3 g |
| $K_2IrCl_6$ (0.001%) | 0.5 ml |
| $H_2O$ to make | 600 ml |
| (7th solution) | |
| $AgNO_3$ | 120 g |
| $H_2O$ to make | 600 ml |

The 1st solution was heated to 75° C. and the 2nd and 3rd solutions were added thereto.

Then the 4th and 5th solutions were simultaneously added thereto over 10 minutes.

After a further 10 minutes had passed, the 6th and 7th solutions were simultaneously added thereto over 35 minutes. Five minutes later the temperature was lowered and desalting was effected. Then water and dispersed gelatin were added and the pH was adjusted to 6.3, thereby giving a monodisperse emulsion of cubic silver halide grains having an average grain size of 1.1 μm and a deviation coefficient (a value obtained by dividing the standard deviation of grain size by the average grain size: s/d) of 0.10.

To 1.0 kg of the thus-prepared emulsion, 26 ml of 0.6% solution of a blue spectral-sensitizing dye (S-1) was added. Then, an ultra-fine grain emulsion of 0.05 μm AgBr was added in a ratio of 0.5 mol % to the host AgCl emulsion, and they were mixed and ripened at 58° C. for 10 minutes. Thereafter the emulsion was optimally chemically-sensitized by adding of sodium thiosulfate, and a stabilizer (Stb-1) was added in an amount of $10^{-4}$ mol per mol of Ag.

| Green-sensitive emulsion | |
|---|---|
| (8th solution) | |
| $H_2O$ | 1000 ml |
| NaCl | 3.3 g |
| Gelatin | 32 g |
| (9th solution) | |
| Sulfuric acid (1 N) | 24 ml |
| (10th solution) | |
| Compound A (1%) | 3 ml |
| (11th solution) | |
| NaCl | 11.00 g |
| $H_2O$ to make | 200 ml |
| (12th solution) | |
| $AgNO_3$ | 32.00 g |
| $H_2O$ to make | 200 ml |
| (13th solution) | |
| NaCl | 44.00 g |
| $K_2IrCl_6$ (0.001%) | 2.3 ml |
| $H_2O$ to make | 560 ml |
| (14th solution) | |
| $AgNO_3$ | 128 g |
| $H_2O$ to make | 560 ml |
| (15th solution) | |
| KBr | 5.60 g |
| $H_2O$ | 280 ml |

The 8th solution was heated to 52° C. and the 9th and 10th solutions were added thereto. Then the 11th and 12th solutions were simultaneously added thereto over 14 minutes. After a further 10 minutes had passed, the 13th and 14th solutions were simultaneously added thereto over 15 minutes.

After a sensitizing dye (S-2) was added to the emulsion in an amount of $4\times10^{-4}$ mol per mol of silver halide, the 15th solution was added over 10 minutes. After a further 5 minutes had past, the temperature was lowered and desalting was effected.

Water and dispersed gelatin were added thereto and the pH was adjusted to 6.2. Thereafter, the emulsion was optimally chemically-sensitized by adding sodium thiosulfite at 58° C. to obtain a monodisperse emulsion of cubic silver halide grains having an average grain size of 0.48 μm and a deviation coefficient of 0.10.

A stabilizer (Stb-1) was added in an amount of $5\times10^{-4}$ mol per mol of silver halide.

RED-SENSITIVE EMULSION

A red-sensitive emulsion was prepared by repeating the same procedure for the green-sensitive emulsion, except that the sensitizing dye was changed to dye (S-3) in an additive amount of $1.5\times10^{-4}$ mol per mol of silver halide.

The compounds used are shown below.

(S-1) Sensitizing dye

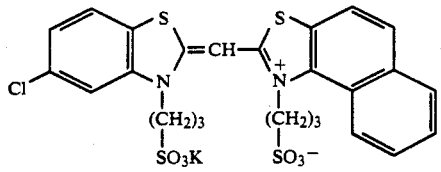

(S-2) Sensitizing dye

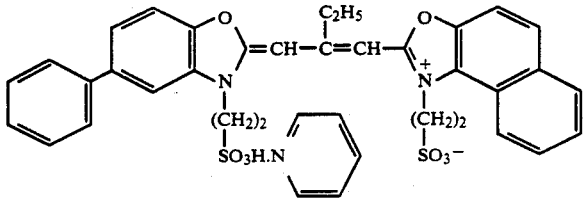

(S-3) Sensitizing dye

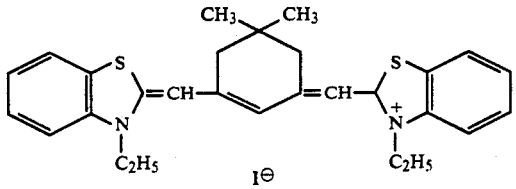

(Stb-1) Stablizer

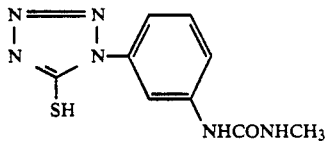

COMPOSITIONS OF LAYERS

The compositions of the layers were as follows. The values represent the coating amount in g/m$^2$. The amount of each silver halide emulsion is represented by the coating amount n terms of silver.

| | |
|---|---|
| Base: Polyethylene-laminated paper (a white pigment, $TiO_2$, and a bluish dye, ultramarine, were included in the polyethylene film of the first layer side) | |
| First layer: Blue-sensitive emulsion layer | |
| Silver halide emulsion | 0.25 |
| Gelatin | 1.86 |
| Yellow coupler (ExY) | 0.82 |
| Image-dye stabilizer (Cpd-1) | 0.19 |
| Solvent (Solv-1) | 0.35 |
| Second layer: Color-mix-preventing layer | |
| Gelatin | 0.99 |
| Color-mix inhibitor (Cpd-2) | 0.08 |
| Third layer: Green-sensitive emulsion layer | |
| Silver halide emulsion | 0.31 |
| Gelatin | 1.24 |
| Magenta coupler (ExM) | 0.60 |
| Image-dye stabilizer (Cpd-3) | 0.25 |
| Image-dye stabilizer (Cpd-4) | 0.12 |
| Solvent (Solv-2) | 0.42 |
| Fourth layer: Ultraviolet-absorbing layer | |
| Gelatin | 1.58 |
| Ultraviolet absorbent (UV-1) | 0.62 |
| Color-mix inhibitor (Cpd-5) | 0.05 |
| Solvent (Solv-3) | 0.24 |
| Fifth layer: Red-sensitive emulsion layer | |
| Silver halide emulsion | 0.21 |
| Gelatin | 1.34 |
| Cyan coupler (a blend of ExC1 and ExC2 in a ratio of 1:1) | 0.34 |
| Image-dye stabilizer (Cpd-6) | 0.17 |
| Polymer (Cpd-7) | 0.40 |
| Solvent (Solv-4) | 0.23 |
| Sixth layer: Ultraviolet-absorbing layer | |

-continued

| | |
|---|---|
| Gelatin | 0.53 |
| Ultraviolet absorbent (UV-1) | 0.21 |
| Solvent (Solv-3) | 0.08 |
| Seventh layer: Protective layer | |
| Gelatin | 1.33 |
| Acrylic-modified (modification degree: 17%) copolymer of poly(vinyl alcohol) | 0.17 |
| Liquid paraffin | 0.03 |

The sodium salt of 1-oxy-3,5-dichloro-s-triazine was used as a hardening agent for each layer.

These coated samples were subjected to the following experiment to evaluate their photographic characteristics.

First, each of the coated samples was subjected to a gradational exposure of light for a sensitometry using a sensitometer (FWH-type, made by Fuji Photo Film Co., Ltd., color temperature at light source: 3200K). The exposure was conducted to give an exposure time of one-tenth second and an exposure amount of 250 CMS.

Thereafter they were subjected to continuous processing (running test) according to the processing steps described below using the processing solutions described below until the color-developer volume replenished is twice as much as the tank volume. The composition of the color-developer was changed as shown in Table 1, and each developer was subjected to the running test.

At the beginning and the end of the running test, each sample was subjected to the above-described sensitometry, and then the minimum densities (Dmin) and the maximum densities (Dmax) of blue (B), green (G), and red (R), and the gradation (the difference of densities from 0.5 to a value at the point of exposure higher 0.3 in log E) were determined using a Macbeth densitometer. The changes from the beginning to the end of the continuous processing are shown in Table 1.

At the same time, the existence of suspended matters in the color-developer after the running test was evaluated by visual inspection. The results are shown in Table 1.

| Processing Step | Temperature (°C.) | Time (sec.) | Replenisher Amount (ml)* | Tank (l) |
|---|---|---|---|---|
| Color-developing | 38 | 45 | 90 | 8 |
| Bleach-fixing | 30–36 | 45 | 161 | 8 |
| Rinsing ① | 30–37 | 20 | — | 4 |
| Rinsing ② | 30–37 | 20 | — | 4 |
| Rinsing ③ | 30–37 | 20 | — | 4 |
| Rinsing ④ | 30–37 | 20 | 200 | 4 |
| Drying | 70–80 | 60 | | |

*Replenisher amount per $m^2$ of photographic material (Rinsing steps were carried out in a four-tank cascade mode from tank of rinsing ④ toward tank of rinsing ①.)

The composition of the processing solutions were as follows:

| | Tank solution | Replenisher |
|---|---|---|
| Color-Developing Solution | | |
| Water | 800 ml | 800 ml |
| Ethylenediamine-N,N,N,N-tetramethylenephosphonate | 3.0 g | 6.0 g |
| Organic preservative A | 0.03 mol | 0.07 mol |
| Sodium chloride | 4.2 g | 0.0 g |
| Potassium carbonate | 25 g | 25 g |
| N-Ethyl-N-(β-methanesulfonamidoethyl)-3-methyl-4-aminoaniline sulfate | 5.0 g | 11.0 g |
| Organic preservative B | 0.05 mol | 0.07 mol |
| Fluorescent brightening agent (4,4-diaminostilbene series) | 2.0 g | 4.0 g |
| Sodium sulfite | See Table 1 | |
| Water to make | 1000 ml | 1000 ml |
| pH (25° C.) | 10.05 | 10.85 |
| Bleach-Fixing Solution | | |
| (Both the tank solution and replenisher are the same) | | |
| Water | 400 ml | |
| Ammonium thiosulfate (70%) | 100 ml | |
| Sodium sulfite | 17 g | |
| Iron (III) ammonium ethylenediaminetetraacetate | 55 g | |
| Disodium ethylenediaminetetraacetate | 5 g | |
| Ammonium bromide | 40 g | |
| Glacial acetic acid | 9 g | |
| Water to make | 1000 ml | |
| pH (25° C.) | 5.40 | |
| Rinsing Solution | | |
| (Both the tank solution and replenisher are the same) | | |
| Ion-exchanged water (each content of calcium and magnesium was 3 ppm or less) | | |

TABLE 1

| Processing Process | | ① | ② | ③ | ④ | ⑤ | ⑥ | ⑦ | ⑧ |
|---|---|---|---|---|---|---|---|---|---|
| Sodium Sulfite (g/l) | | | | | | | | | |
| Tank Solution | | 1.7 | 1.7 | 0.8 | — | — | — | — | — |
| Replenisher | | 3.5 | 3.5 | 2.0 | — | — | — | — | — |
| Organic Preservative A | | Hydroxylamine | I-1 | I-1 | I-1 | I-1 | III-19 | III-19 | III-21 |
| Organic Preservative B | | — | — | VII-1 | — | VII-1 | VII-1 | XVI-7 | XVI-7 |
| Remarks | | Comparative Example | | | This Invention | | | | |
| BL | $\Delta_{min}$ | +0.03 | +0.03 | +0.02 | +0.02 | 0 | 0 | 0 | 0 |
| | $\Delta_{max}$ | +0.35 | +0.25 | +0.21 | +0.09 | −0.05 | −0.02 | −0.03 | −0.04 |
| | ΔGradation | +0.17 | +0.12 | +0.09 | +0.04 | +0.03 | +0.01 | +0.01 | +0.02 |
| GL | $\Delta_{min}$ | +0.01 | +0.01 | +0.01 | +0.01 | 0 | 0 | 0 | 0 |
| | $\Delta_{max}$ | +0.31 | +0.22 | +0.18 | +0.07 | −0.03 | −0.01 | −0.01 | −0.02 |
| | ΔGradation | +0.17 | +0.13 | +0.09 | +0.04 | +0.01 | −0.01 | 0 | +0.01 |
| RL | $\Delta_{min}$ | 0 | 0 | 0 | 0 | 0 | 0 | 0 | 0 |
| | $\Delta_{max}$ | +0.41 | +0.32 | +0.30 | +0.11 | −0.08 | −0.03 | −0.04 | −0.05 |
| | ΔGradation | +0.22 | +0.18 | +0.14 | +0.04 | +0.03 | +0.01 | +0.02 | +0.02 |
| Suspended Matter* | | XX | XX | X | Δ | ○ | ○ | ○ | ○ |

*Evaluation of suspended matter
○ . . . None,
Δ . . . Found a little,
X . . . Found,
XX . . . Found many.

As is apparent from the results in Table 1, when a running process was carried out using a color-developer containing sulfite ions, as in processing processes ① to ③, there were great changes of in the photographic characteristics, especially in maximum density (Dmax) and gradation, from the beginning to the end of the running process, and a large amount of suspended matter, which seemed to be eluted silver from the photographic material, was observed in the color-developer after the running process.

However, when the running process was carried out using a color-developer not containing sulfite ions according to the present invention, as in processing processes ④ to ⑧, the changes in the photographic characteristics during the running process were apparently decreased, and practically no suspended matter as described above appeared after the running process. In particular, in processing processes ⑥ and ⑦, which used exemplified compound III-19 as organic preservative A, and each of Exemplified compounds VII-1 and XV 1 as organic preservative B, there were practically no changes in the photographic characteristics during the running process, and the above-described suspended matter did not appear at all. Thus according to the present invention it becomes to be possible to decrease greatly the replenisher amount of developer without marring the rapidness of the process.

EXAMPLE 2

When a running process was repeated in the same manner as in Example 1, except that Exemplified compound I-1 in processing process ⑤ was changed to each Exemplified compound I-2, II-1, III-15, IV-5, V-1, or VI-5, the same preferable results were obtained in all cases. Further the same preferable results were obtained similarly using VIII-5, VIII-8, IX-1, XI-3, X-1, X-3, XI-1, XI-2, XII-3, XII-10, XIII-8, XIV-1, XV-1, XV-6, or XVI-1 instead of XVI-7 in processing process (7).

EXAMPLE 3

Multilayer color photographic papers A, B, C, and D were prepared with layers as hereinbelow described on each paper laminated on both sides with polyethylene. Coating solutions were prepared as follows:

PREPARATION OF THE FIRST-LAYER COATING SOLUTION

To a mixture of 19.1 g of yellow coupler (ExY-1) and 4.4 g of an image-dye stabilizer (Cpd-1), 27.2 ml of ethyl acetate and 7.7 ml (8.0 g) of a high boiling solvent (Solv-1) were added and dissolved. The resulting solution was emulsified and dispersed in 185 ml of 10% aqueous gelatin solution containing 8 ml of a 10% solution of sodium dodecylbenzensulfonate. Each of emulsions EM7 and EM8 was mixed with the above-obtained emusified and dispersed solution and dissolved, and the concentration of gelatin in the mixture was adjusted to obtain the composition shown below, thereby preparing the first-layer coating solution. The second to the seventh-layer coating solutions were prepared in the same manner as the first coating solution. As a gelatin hardener for the respective layers, the sodium salt of 1-oxy-3,5-dichloro-2-triazine was used. As a thickener, a compound (Cpd-2) was used.

COMPOSITION OF LAYERS

The composition of each layer is shown below. Each ingredient is indicated in g/m$^2$ of a coating amount, but the coating amount of silver halide is shown in g/m$^2$ in terms of silver.

| | |
|---|---|
| Supporting base: Polyethylene-laminated paper (a white pigment, $TiO_2$, and a bluish dye, ultramarine, were included in the first-layer side of the polyethylene-laminated film). | |
| First layer: Blue-sensitive layer | |
| Monodisperse silver chlorobromide emulsion (EM7) spectral-sensitized by sensitizing dye (ExS-1) | 0.15 |
| Monodisperse silver chlorobromide emulsion (EM8) spectral-sensitized by sensitizing dye (ExS-1) | 0.15 |
| Gelatin | 1.86 |
| Yellow coupler (ExY-1) | 0.82 |
| Image-dye stabilizer (Cpd-2) | 0.19 |
| Solvent (Solv-1) | 0.35 |
| Second layer: Color-mix-preventing layer | |
| Gelatin | 0.99 |
| Color-mix inhibitor (Cpd-3) | 0.08 |
| Third layer: Green-sensitive emulsion layer | |
| Monodisperse silver chlorobromide emulsion (EM9) spectral-sensitized by sensitizing dye (ExS-2, -3) | 0.12 |
| Monodisperse silver chlorobromide emulsion (EM10) spectral-sensitized by sensitizing dye (ExS-2, -3) | 0.24 |
| Gelatin | 1.24 |
| Magenta coupler (ExM-1) | 0.39 |
| Image-dye stabilizer (Cpd-4) | 0.25 |
| Image-dye stabilizer (Cpd-5) | 0.12 |
| Solvent (Solv-2) | 0.25 |
| Fourth layer: UV-absorbing layer | |
| Gelatin | 1.60 |
| UV absorbent (Cpd-6/Cpd-7/Cpd-8 = 3/2/6 in wt. ratio) | 0.70 |
| Color-mix inhibitor (Cpd-9) | 0.05 |
| Solvent (Solv-3) | 0.42 |
| Fifth layer: Red-sensitive emulsion layer | |
| Monodisperse silver chlorobromide emulsion (EM11) spectral-sensitized by sensitizing dye (ExS-4, -5) | 0.07 |
| Monodisperse silver chlorobromide emulsion (EM12) spectral-sensitized by sensitizing dye (ExS-4, -5) | 0.16 |
| Gelatin | 0.92 |
| Cyan coupler (ExC-1) | 1.46 |
| Cyan coupler (ExC-2) | 1.84 |
| Image-dye stabilizer (Cpd-7/Cpd-8/Cpd-10 = 3/4/2 in wt. ratio) | 0.17 |
| Polymer for dispersion (Cpd-11) | 0.14 |
| Solvent (Solv-1) | 0.20 |
| Sixth layer: UV-absorbing layer | |
| Gelatin | 0.54 |
| UV absorbent (Cpd-6/Cpd-8/Cpd-10) = 1/5/3 in wt. ratio) | 0.21 |
| Solvent (Solv-4) | 0.08 |
| Seventh layer: Protective layer | |
| Gelatin | 1.33 |
| Acryl-modified copolymer of poly (vinyl alcohol) (modification degree: 17%) | 0.17 |
| Liquid paraffin | 0.03 |

For preventing irradiation, dyes (Cpd-12 and -13) were used.

In addition, Alkanol XC (tradename, made by Dupont) and sodium alkylenzenesulfonate were used as auxiliary agents for emulsification and dispersion, and succinate ester and Magnefac F-120 (tradename, made by Dainippon Ink) were added to each layer as coating aids. Further, Cpd-14 and Cpd-15 were used as stabilizers for the layers containing silver halide.

The silver halide emulsions used in this Example were as follows:

| Emulsion | Shape | Grain size (μm) | Br Content (mol %) | Deviation coefficient* |
|---|---|---|---|---|
| EM7 | Cubic | 1.1 | 1.0 | 0.10 |
| EM8 | Cubic | 0.8 | 1.0 | 0.10 |
| EM9 | Cubic | 0.45 | 1.5 | 0.09 |
| EM10 | Cubic | 0.34 | 1.5 | 0.09 |
| EM11 | Cubic | 0.45 | 1.5 | 0.09 |
| EM12 | Cubic | 0.34 | 1.6 | 0.10 |

*The values show distribution degree of grains as follows: standard deviation/av. grain size The chemical formulas of compounds used are as follows:

ExY-1
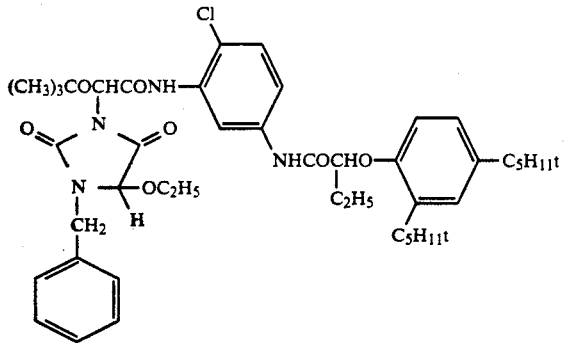
ExM-1
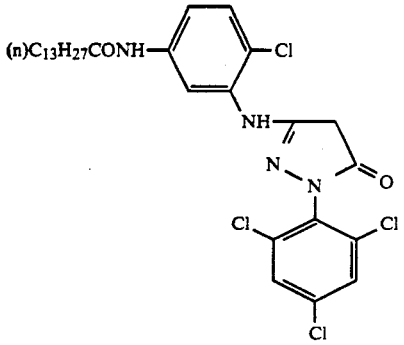
ExC-1
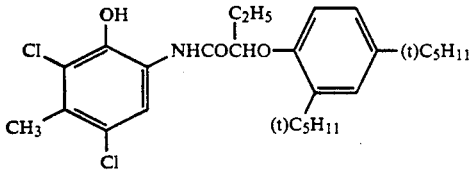
ExC-2
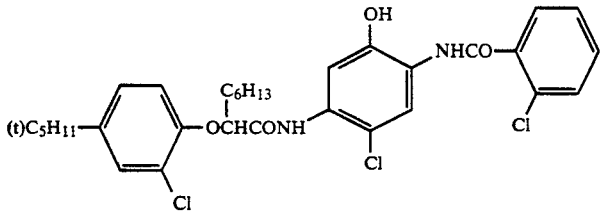
ExS-1
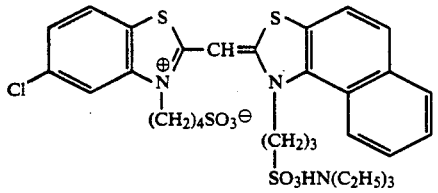
ExS-2
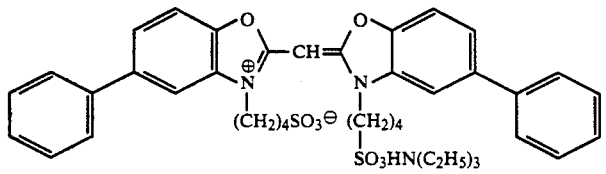

-continued
ExS-3
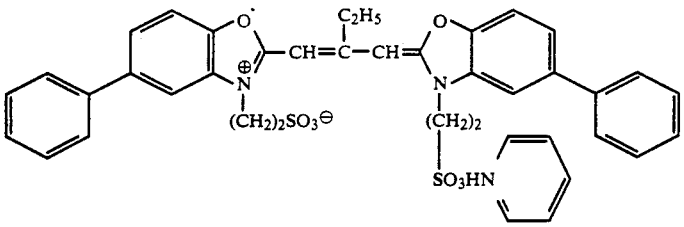
ExS-4
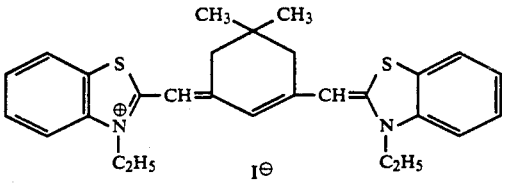
ExS-5
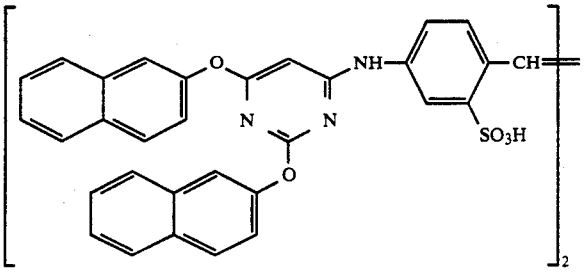
Cpd-1
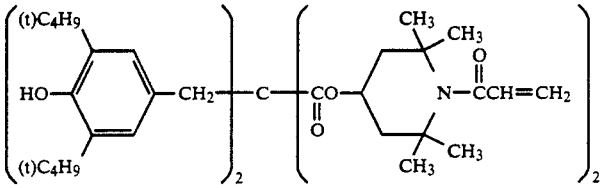
Cpd-2
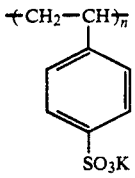
Cpd-3
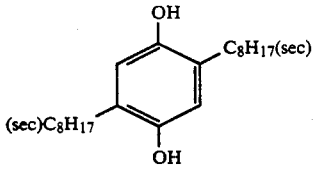
Cpd-4
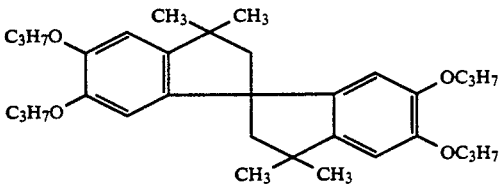
Cpd-5
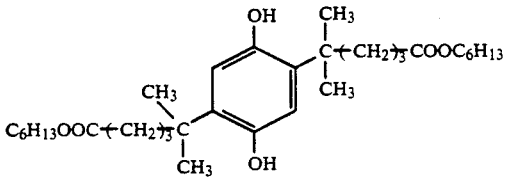

-continued
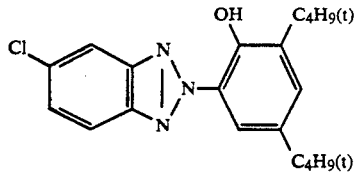
Cpd-6
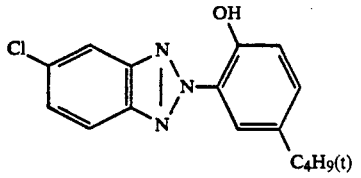
Cpd-7
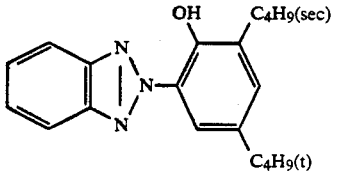
Cpd-8
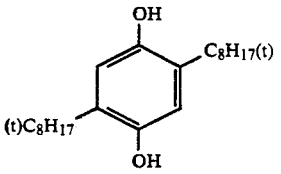
Cpd-9
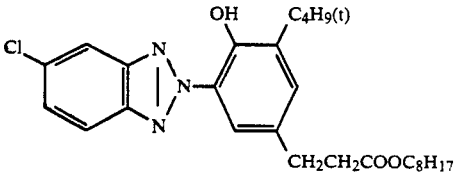
Cpd-10
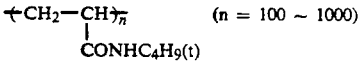
(n = 100 ~ 1000)
Cpd-11
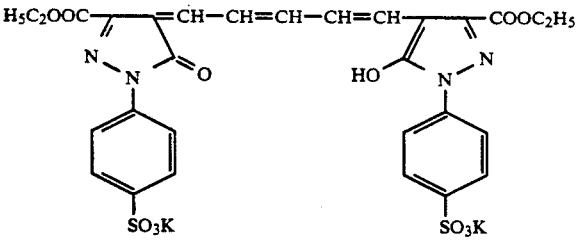
Cpd-12
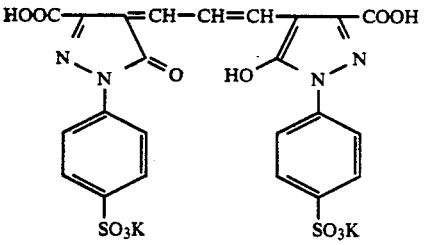
Cpd-13
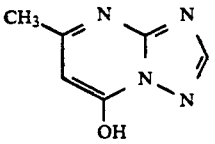
Cpd-14

-continued

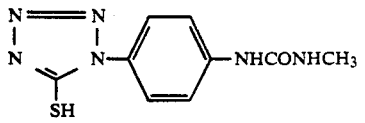

Cpd-15

| | |
|---|---|
| Dibutyl phthalate | Solv 1 |
| Trioctyl phosphate | Solv 2 |
| Trinonyl phosphate | Solv 3 |
| Tricresyl phosphate | Solv 4 |

The coating amount n terms of silver (g/m$^2$) of each layer was changed as follows:

| Layer | Emulsion | Sample A | B | C | D |
|---|---|---|---|---|---|
| First Layer | EM7 | 0.18 | 0.15 | 0.12 | 0.11 |
| | EM8 | 0.18 | 0.15 | 0.12 | 0.11 |
| Third Layer | EM9 | 0.12 | 0.12 | 0.12 | 0.11 |
| | EM10 | 0.24 | 0.24 | 0.20 | 0.19 |
| Fifth Layer | EM11 | 0.09 | 0.07 | 0.07 | 0.05 |
| | EM12 | 0.12 | 0.16 | 0.16 | 0.12 |
| Summary | | 0.97 | 0.89 | 0.79 | 0.69 |

The above-described photographic materials A, B, C, and D were subjected to an imagewise light exposure, and then to continuous processing (running test) using a paper-processor in the following processing process, until the replenisher-amount of the developing solution equaled twice the volume of the color-developing tank. Two types of color-developer of the composition described below (CD-1 and CD-2) were used.

| Processing step | Temperature (°C.) | Time (sec.) | Replenisher Amount (ml)* | Tank (l) |
|---|---|---|---|---|
| Color-developing | 38 | 60 | 30 | 4 |
| Bleach-fixing | 30–36 | 45 | 215 | 4 |
| Stabilizing ① | 30–37 | 20 | — | 2 |
| Stabilizing ② | 30–37 | 20 | – | 2 |
| Stabilizing ③ | 30–37 | 20 | – | 2 |
| Stabilizing ④ | 30–37 | 20 | 200 | 4 |
| Drying | 70–80 | 60 | | |

*Replenisher amount per m$^2$ of photographic material (Rinsing steps were carried out in a four-tank cascade mode from tank of stabilizing ④ toward tank of stabilizing ①.)

The composition of the processing solutions were as follows:

| Color-Developing Solution (CD-1) | Tank Solution | Replenisher |
|---|---|---|
| Water | 800 ml | 800 ml |
| Ethylenediaminetetraacetate | 5.0 g | 5.0 g |
| 5,6-Dihydroxybenzene-1,2,4-trisulfonate | 0.3 g | 0.3 g |
| Triethanoleamine | 8.0 g | 8.0 g |
| Sodium chloride | 8.4 g | 0.0 g |
| Potassium carbonate | 25 g | 25 g |
| N-Ethyl-N-(β-methanesulfonamidemethyl)-3-methyl-4-aminoaniline sulfate | 5.0 g | 15.0 g |
| Diethylhydroxylamine | 4.2 g | 10.0 g |
| Fluorescent brightening agent | 2.0 g | 5.0 g |

-continued

| Color-Developing Solution (CD-1) | Tank Solution | Replenisher |
|---|---|---|
| (4,4-diaminostilbene series) | | |
| Sodium sulfite | 1.7 g | 5.5 g |
| Water to make | 1000 ml | 1000 ml |
| pH (25° C.) | 10.05 | 11.00 |

CD-2 was the same as CD-1, except that sodium sulfite was excluded

| Bleach-Fixing Solution | |
|---|---|
| (both the tank solution and replenisher are the same) | |
| Water | 400 ml |
| Ammonium thiosulfate (70%) | 100 ml |
| Sodium sulfite | 17 g |
| Iron (III) ammonium ethylenediaminetetraacetate | 55 g |
| Disodium ethylenediaminetetraacetate | 5 g |
| Ammonium bromide | 40 g |
| Glacial acetic acid | 9 g |
| Water to make | 1000 ml |
| pH (25° C.) | 5.40 |
| **Stabilizing Solution** | |
| (both the tank solution and replenisher are the same) | |
| Formalin (37%) | 0.1 g |
| Formalin-sulfic acid adduct | 0.7 g |
| 5-Chloro-2-methyl-4-isothiazoline-3-on | 0.02 g |
| 2-Methyl-4-isothiazoline-3-on | 0.01 g |
| Aqueous ammonia (28%) | 2.0 ml |
| Water to make | 1000 ml |
| pH (25° C.) | 4.0 |

As in Example 1, changes of Dmax and the existence of suspended matter were tested and the results are shown in Table 2.

Continuous processing (running test) of photographic materials A to D according to the processing processes ⑤ to ⑧ were carried out until the color-developer volume replenished is four times as much as the tank volume of color-developer.

After the processing, the occurrence of suspended matter in the processing solution was evaluated by visual obsevation. An increase in suspended matter was observed in processings ⑤ and ⑥, but the occurrence of suspended matter was not still observed in processings ⑦ and ⑧.

Thus, it was unexpected fact that the occurrence of suspended matter in a developer, which causes a problem of the photographic quality, can be prevented by lowering the silver coating amount to 0.8 g/m$^2$ or below.

TABLE 2

| Processing Process | ① | ② | ③ | ④ | ⑤ | ⑥ | ⑦ | ⑧ |
|---|---|---|---|---|---|---|---|---|
| Developing Solution | CD-1 | CD-1 | CD-1 | CD-1 | CD-2 | CD-2 | CD-2 | CD-2 |
| Photographic Material | A | B | C | D | A | B | C | D |
| Remarks | Comparative Example | | | | This Invention | | | |

TABLE 2-continued

| | | | | | | | | | |
|---|---|---|---|---|---|---|---|---|---|
| BL | $\Delta D_{max}$ | +0.37 | +0.38 | +0.42 | +0.41 | −0.11 | −0.10 | −0.08 | −0.06 |
| GL | $\Delta D_{max}$ | +0.44 | +0.46 | +0.49 | +0.49 | −0.08 | −0.07 | −0.05 | −0.04 |
| RL | $\Delta D_{max}$ | +0.59 | +0.58 | +0.60 | +0.61 | −0.08 | −0.06 | −0.06 | −0.04 |
| Suspended Matter | | XX | XX | XX | XX | Δ | Δ | ○ | ○ |

Note: Evaluation of suspended matter:
○ . . . None,
Δ . . . Found a little,
X . . . Found,
XX . . . Found many.

As is apparent from the results in Table 2, when a running process was carried out using a color-developer (CD-1) containing sulfite ions, as in processing processes (1) to (4), there were great changes in the photographic characteristics, especially in maximum density (Dmax) and gradation, from the beginning to the end of running process, and a large amount of suspended matter, which seemed to be eluted silver from the photographic material, was observed in the color-developer after the running process.

However, when the running process was carried out using a color-developer (CD-2) not containing sulfite ions according to the present invention, as in processing processes (5) to (8), the changes in the photographic characteristics during the running process decreased, and practically no suspended matter, as described above, appeared after the running process. As such conditions were much improved, compared to those of processing processes (1) to (4). It is understood that the coating amount of photographic material in terms of silver is particularly preferably 0.80 g/m$^2$ or less in the present invention, since the changes in maximum density were smaller and the above-described suspended matter did not appear at all after processing processes (7) and (8).

EXAMPLE 4

When the running process was repeated in the same manner as in Example 3, except that diethylhydroxylamine in the color-developer CD-2 was changed to each equal mole of Exemplified compound I-2, III-15, III-19, III-21, IV-5, V-1, or VI-5, similar excellent results were obtained in all cases.

EXAMPLE 5

When the running process was repeated in the same manner as in Example 3, except that triethanolamine in the color-developer CD-2 was changed to each equal mole of Exemplified compound VIII-5, VIII-8, IX-1, IX-3, X-1, X-3, XI-1, XI-2, XII-3, XII-10, XIII-8, XIV-1, XV-1, XV-6, XV-7, and XVI-7, similar excellent results were obtained.

Having described our invention as related to the embodiment, it is our intention that the invention be not limited by any of the details of the description, unless otherwise specified, but rather be construed broadly within its spirit and scope as set out in the accompanying claims.

What we claim is:

1. A method for continuously processing a silver halide color photographic material with a color developer containing at least one aromatic primary amine color-developing agent, which comprises developing, after exposure to light, a silver halide color photographic material having a total coating amount of silver halide in terms of silver of from 0.40 to 0.70 g/m$^2$ and at least one of the layers of which contains a silver halide emulsion comprising at least 80 mol % silver chloride, with a color developer that is substantially free from sulfite ions and whose replenishing amount is 20 to 120 ml per square meter of photographic material.

2. The method as claimed in claim 1, wherein the color developer is substantially free from hydroxylamine.

3. The method as claimed in claim 1, wherein the color developer contains an organic preservative.

4. The method as claimed in claim 1, wherein the color developer contains at least one organic preservative selected from hydroxylamine derivatives, hydroxamic acids, hydrazines, hydrazides, phenols, α-hydroxyketones, α-aminoketones, saccharides, monoamines, diamines, polyamines, quaternary ammonium salts, nitroxy radicals, alcohols, oximes, diamide compounds, and condensed ring-type amines.

5. The method as claimed in claim 1, wherein the aromatic primary amine color developing agent is a p-phenylenediamine derivative.

6. The method as claimed in claim 1, wherein the color developer contains (i) at least one preservative selected from hydroxylamine derivatives, hydroxamic acids, hydrazines, hydrazides, phenols, α-hydroxyketones, α-aminoketones, saccharides and (ii) at least one preservative selected from monoamines, diamines, polyamines, quaternary ammonium salts, nitroxy radicals, alcohols, oximes, diamide compounds, and condensed ringtype amines.

7. The method as claimed in claim 1, wherein the color developer contains (i) at least one preservative selected from hydroxylamine derivatives represented by formula (I):

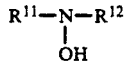

Formula (I)

wherein $R^{11}$ and $R^{12}$ each represent a hydrogen atom, a substituted or unsubstituted alkyl group, a substituted or unsubstituted alkenyl group, a substituted or unsubstituted aryl group, or a heteroaromatic group, they do not represent hydrogen atoms at the same time, and they may bond together to form a heterocyclic ring with the nitrogen atom, and hydrazines and hydrazies represented by formula (III):

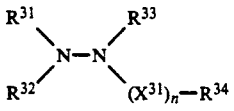

Formula (III)

wherein $R^{31}$, $R^{32}$, and $R^{33}$ each independently represent a hydrogen atom, a substituted or unsubstituted alkyl group, a substituted or unsubstituted aryl group, or a substituted or unsubstituted heterocyclic group; $R^{34}$ represents a hydroxy group, a hydroxyamino group, a substituted or unsubstituted alkyl group, a substituted or unsubstituted heterocyclic group, a substituted or unsubstituted alkoxy group, a substituted or unsubstituted aryloxy group, a substituted or unsubstituted carbamoyl group, or a substituted or unsubstituted amino group, and (ii) at least one preservative selected from monoamines represented by formula (VII):

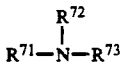

Formula (VII)

wherein $R^{71}$, $R^{72}$, and $R^{73}$ each represent a hydrogen atom, an alkyl group, an alkenyl group, an aryl group, an aralkyl group or a heterocyclic group, and $R^{71}$ and $R^{72}$, $R^{71}$ and $R^{73}$, or $R^{73}$ may bond together to form a nitrogen-containing heterocyclic group, and amines having a condensed ring represented by formula (XVI):

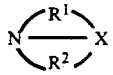

Formula (XVI)

wherein X represents a trivalent group of atoms necessary to complete a condensed ring, and $R^1$ and $R^2$ each represent an alkylene group, an arylene group, an alkenylene group, or an aralkylene group, and $R^1$ and $R^2$ may be the same or different.

8. The method as claimed in claim 1, wherein the pH of the color developer is in the range of 9 to 12.

9. The method as claimed in claim 1, wherein the silver halide emulsion of the at least one of the layers contains 95 mol % or over of silver chloride.

10. The method as claimed in claim 1, wherein the color developer is substantially free from benyl alcohol.

* * * * *